US007510190B2

(12) United States Patent
Snow et al.

(10) Patent No.: US 7,510,190 B2
(45) Date of Patent: Mar. 31, 2009

(54) HIGH-LOW POKER WAGERING GAMES

(75) Inventors: Roger M. Snow, Las Vegas, NV (US); Robert Scott, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 532 days.

(21) Appl. No.: 10/910,799

(22) Filed: Aug. 2, 2004

(65) Prior Publication Data

US 2005/0127606 A1 Jun. 16, 2005

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | |
|---|---|---|---|
| 3,667,757 | A | 6/1972 | Holmberg |
| 3,876,208 | A | 4/1975 | Wächtler et al. |
| 3,939,953 | A | 2/1976 | Miyazawa |
| 4,305,586 | A | 12/1981 | Richards |
| 4,593,904 | A | 6/1986 | Graves |
| 4,651,997 | A | 3/1987 | Wood |
| 4,652,998 | A | 3/1987 | Koza et al. |
| 4,659,087 | A | 4/1987 | Shen et al. |
| 4,743,022 | A | 5/1988 | Wood |
| 4,756,531 | A | 7/1988 | DiRe et al. |
| 4,807,884 | A | 2/1989 | Breeding |
| 4,813,675 | A | 3/1989 | Greenwood |
| 4,836,546 | A | 6/1989 | DiRe et al. |
| 4,836,553 | A | 6/1989 | Suttle et al. |
| 4,837,728 | A | 6/1989 | Barrie et al. |

(Continued)

FOREIGN PATENT DOCUMENTS

| | | |
|---|---|---|
| EP | 0443420 | 8/1991 |
| GB | 9414822 | 7/1994 |
| GB | 9426324 | 12/1994 |

OTHER PUBLICATIONS

John Scarne, Scarne's Enclyclopedia Of Games, 1973, Harper & Row, pp. 7-18.*

(Continued)

*Primary Examiner*—Gene Kim
*Assistant Examiner*—Dolores Collins
(74) *Attorney, Agent, or Firm*—Mark A. Litman & Associates P.A.

(57) ABSTRACT

A method of playing a wagering game comprises the steps of a player placing a first wager to participate in the wagering game and dealing at least a partial hand of cards to each player participating in the wagering game. The method includes providing a set of winning outcomes and corresponding payout odds against a pay table, wherein the set of winning outcomes includes at least one predetermined minimum high ranking hand and at least one predetermined maximum low ranking hand. Additional card are dealt, if necessary to complete each player hand. The method further includes the step of paying a player a payout on the first wager for obtaining a winning outcome without requiring the player to make an election as between having at least one predetermined minimum high ranking hand and at least one predetermined maximum low ranking hand.

24 Claims, 10 Drawing Sheets

U.S. PATENT DOCUMENTS 4,842,276 A 6/1989 Darby
4,861,041 A 8/1989 Jones et al.
4,882,473 A 11/1989 Bergeron et al.
4,906,005 A 3/1990 Manabe
4,948,134 A 8/1990 Suttle et al.
5,019,973 A 5/1991 Wilcox et al.
5,022,653 A 6/1991 Suttle et al.
5,042,635 A 8/1991 Bell
5,042,818 A 8/1991 Weingardt
5,078,405 A 1/1992 Jones et al.
5,098,107 A 3/1992 Boylan et al.
5,100,137 A 3/1992 Fulton
5,112,060 A 5/1992 Jones
5,114,155 A 5/1992 Tillery et al.
5,116,055 A 5/1992 Tracy
5,154,429 A 10/1992 LeVasseur
5,167,413 A 12/1992 Fulton
5,248,142 A 9/1993 Breeding
5,275,400 A 1/1994 Weingardt et al.
5,275,415 A 1/1994 Wisted
5,288,077 A 2/1994 Jones
5,288,081 A * 2/1994 Breeding ..... 273/292
5,294,128 A * 3/1994 Marquez ..... 273/292
5,308,065 A 5/1994 Bridgeman et al.
5,326,104 A 7/1994 Pease et al.
5,356,140 A 10/1994 Dabrowski et al.
5,364,104 A 11/1994 Jones et al.
5,364,105 A 11/1994 Jones
5,382,025 A 1/1995 Sklansky et al.
5,393,067 A 2/1995 Paulsen et al.
5,417,430 A * 5/1995 Breeding ..... 273/292
5,437,462 A 8/1995 Breeding
5,472,194 A 12/1995 Breeding et al.
5,494,295 A 2/1996 Potter et al.
5,531,440 A 7/1996 Dabrowski et al.
5,544,892 A * 8/1996 Breeding ..... 273/292
5,630,586 A 5/1997 Lowden
5,664,781 A 9/1997 Feola
5,669,817 A 9/1997 Tarantino
5,685,774 A 11/1997 Webb
5,697,614 A 12/1997 Potter et al.
5,743,800 A 4/1998 Huard et al.
5,769,422 A 6/1998 Stromer
5,775,992 A 7/1998 Wood et al.
5,810,663 A 9/1998 Bochichio et al.
5,820,460 A 10/1998 Fulton
5,848,932 A 12/1998 Adams
5,851,011 A 12/1998 Lott
5,863,041 A 1/1999 Boylan et al.
5,901,958 A 5/1999 Andrews
5,941,769 A 8/1999 Order
5,947,821 A 9/1999 Stone
5,957,459 A 9/1999 Chae
5,979,897 A 11/1999 Grossman
5,984,309 A 11/1999 Santin
5,984,310 A 11/1999 English
5,988,643 A 11/1999 Awada
6,012,719 A 1/2000 Webb
6,019,374 A * 2/2000 Breeding ..... 273/292
6,036,190 A 3/2000 Edmunds et al.
6,056,641 A 5/2000 Webb
6,126,166 A 10/2000 Lorson et al.
6,135,453 A 10/2000 Srichayaporn
6,149,154 A 11/2000 Grauzer et al.
6,237,916 B1 5/2001 Webb
6,273,424 B1 * 8/2001 Breeding ..... 273/292
6,299,534 B1 10/2001 Breeding
6,311,979 B1 * 11/2001 Andrews ..... 273/292
6,313,871 B1 11/2001 Schubert
6,334,613 B1 * 1/2002 Yoseloff ..... 273/292
6,334,614 B1 1/2002 Breeding
6,345,823 B1 * 2/2002 Webb ..... 273/292
6,406,020 B1 6/2002 Reed
6,454,266 B1 * 9/2002 Breeding et al. ..... 273/292
6,460,848 B1 10/2002 Soltys et al.
6,508,470 B1 * 1/2003 Yuan ..... 273/292
6,698,759 B2 3/2004 Webb et al.
6,869,076 B1 * 3/2005 Moore et al. ..... 273/292
6,923,446 B2 * 8/2005 Snow ..... 273/292
6,938,900 B2 * 9/2005 Snow ..... 273/292
6,959,928 B2 * 11/2005 Schultz ..... 273/292
7,032,902 B1 * 4/2006 Yuan ..... 273/274
7,147,227 B2 * 12/2006 Taghavi ..... 273/292
7,165,770 B2 * 1/2007 Snow ..... 273/292
2003/0022709 A1 * 1/2003 Awada ..... 463/12
2003/0199316 A1 * 10/2003 Miyamoto et al. ..... 463/35

OTHER PUBLICATIONS

Silberstang's Encyclopedia of Games and Gambling, Edwin Silberstang, Cardoza Publishing, 1996, pp. 67-72.
The New Complete Hoyle Revised, Morehead et al., Doubleday Press, 1991, pp. 28-30.
Scarne, Jr., "Scarne's Encyclopedia of Games", Harper & Row Publishers, First Edition, pp. 33-41, Stud Poker, 1973.
J. Scarne, "Scarne's Guide to Modern Poker", Constable and Company Limited, 1979, "Pokino", pp. 160-162.
"Wild Deuces", Michigan Legionaire, Volume XXXII, No. 10, 1 page, (Oct. 1978).
"Declaration of Jim Kilby Under 37 CFR 1.132", 2 pages (May 9, 1995).
Second Amended Petition filed in the Civil Action "In the Matter of the Petition of IGT for Certain Declaratory Rulings and for the Authorization for the Implementation of the Game of Progressive-21". Pages 1-9 (1992).
"Wheel of Gold", Product Information published by Anchor Games, 11 pages (Oct. 1995).
Gros, R., "Working Within the Systems", Casino Journal, vol. 8, No. 12, pp. 10-11, 13, 15, 4 (Dec. 1992).
Smith, C., "Bar Bosses See New Trivia Game Filling More Seats", The Vancouver Sun, 1 page (Feb. 21, 1990).
"Over/Under 13 Blackjack", Product Brochure published by Gaming Concepts, Inc., 3 pages, 1988.
John Scarne Games Inc., Scarne's Guide to Modern Poker, 1980, Draw Poker Variation of Spit in the Ocean, pp. 139-153.
"Poker is the name of the Game", Walter Gibson, 1974, Chapter VIII, Spit in the Ocean (not clearly readable).
"Hoyle's Modern Encyclopedia of Card Games", Walter Gibson, 1993, p. 268-271. (not clearly readable).
"Hoyle's Rules of Games", Edited by Morehead and Mott-Smith, pp. 34-63, "Poker", 1983.
Scarne's Encyclopedia of Games, John Scarne, Harper & Row Publishers, 1983, pp. 278-281, "Banking Card Games".
"Wheel'em™ Stud Poker," Brochure, by DigiDeal Corporation, Spokane, Washington as shown at G2E Expo, Oct. 2004, Las Vegas, Nevada.
"Trips or Better™ Rollover Stud Poker," Brochure, by DigiDeal Corporation, Spokane, Washington as shown at G2E Expo, Oct. 2004, Las Vegas, Nevada.

* cited by examiner

HIGH-LOW POKER WAGERING GAMES

RELATED APPLICATIONS

None.

BACKGROUND OF THE INVENTION

1. Field of the Invention

The present invention relates to the field of gaming, particularly card gaming, and both casino table card games and electronic video gaming apparatus. In particular, a wagering game that may be played on single player video, multiple player video, Internet or live casino table games (or mixed live and automated systems) is described.

2. Background of the Art

Many different wagering games presently exist for use in both home and casino environments. Such games should necessarily be exciting, uncomplicated and easy to learn so as to avoid frustrating the players. Card games such as poker and Twenty-One have gained widespread popularity because of their established ranking of hands and well known rules. Furthermore, each of these games usually involves continuous wagering opportunities for the players thus increasing player participation and excitement. Lastly, the games move fairly quickly to maintain action and activity. All of these factors have created games that are widely accepted and widely known.

Some twenty-one tables offer a side bet game called "Over-Under" or some variation thereof. In addition to the normal markings on the table which are desirable for play of twenty-one (designated spaces for cards, designated spaces for bets, etc.), tables where Over-Under is played also have two additional designated areas for bets. Usually the designated areas for the additional side bets are in the form of circles. Each circle identifies a specific bet, either "Over Thirteen" or "Under Thirteen." Before the turn of the first card in each hand of twenty-one, each player may place a bet as to whether the first two cards will total "Over Thirteen" or "Under Thirteen" by placing a bet in the appropriate circle. An amount of money equal to or less than the basic twenty-one wager may be placed in either circle. After the deal of the first two cards to each player, but before conclusion of the hand, wagers made on the side bet game of Over-Under have their wagers resolved (paid off or captured) by the house. If the bet was Over Thirteen and the total of the cards was over thirteen, the house would pay equal odds on the side bet wager. If the total count of the first two cards was thirteen or under, the house would capture the bet. Ties in this game (any total of thirteen) always allows the house to capture the bet. This side game has attained some level of acceptance and popularity, but payouts are limited to one-to-one odds, with no special awards or multiplication of bets available to increase the excitement of the game. The play of the Over-Under game cannot possibly affect decisions to be made in the play of the Twenty-One game as the Over-Under game is completed when the first two cards are dealt. Play of the Twenty-One game cannot either influence the play of the Over-Under game or vice versa.

Many variations in the play of poker-type games have also been introduced to increase the excitement and interest in the play of both table and video versions of poker. For example, in a video version of draw poker, U.S. Pat. Nos. 5,356,140 and 5,531,440 teach that after an initial wager, two distinct hands may be dealt, and the player may select between the two hands for continued play of the game. Only a single hand and a single game may be played on the wager.

U.S. Pat. No. 5,863,041 describes Pai Gow Poker with an auxiliary game. In the ordinary play of Pai Gow Poker, seven cards are dealt to a player, and the player divides the hand into a five-card poker hand and a two-card poker hand. Each of the hands made by a player must beat equivalently created hands (five and two-card hands) dealt to the dealer. In addition to the normal play of Pai Gow Poker, a player has the option of placing a bonus bet. The bonus bet encompasses the attainment of hands of a predetermined high poker rank and the award of bonuses for attaining those hands only after the bonus bet is made. Although the front hand is referred to as the Low hand, it must only be lower in rank than the High, Back hand, and high front hands are desirable.

In certain gaming jurisdictions, such as Minnesota, a variant of Pai Gow is allowed where a player receiving an extremely low Pai Gow hand (e.g., 9, 8, 7, 5, 4, 3, 2) receives an automatic bonus for the low hand. No separate wager needs to be made on the play to win such a bonus, and the underlying wager is likely to lose on the play of the Pai Gow Game. This variant is played at Canterbury Card Club in Shakopee, Minn.

U.S. Pat. Nos. 5,494,295 and 5,697,614 describe a casino table card game and apparatus in which a player may select any number of predetermined hand ranking rules to apply to the play of a hand. A player is dealt an initial, partial hand, and the player then elects a format of play on that initial hand, which format is based upon selection of a set(s) of predetermined hand ranking rules apply to the hand. In a preferred game, the dealer receives two separate bank hands, one that utilizes the hand ranks of standard poker and one that utilizes the hand ranks of low-ball poker. Once each player has received four of his five cards, each player decides which of the dealer's two hands to play against, with the option of playing against both (as in selecting both ways in a Hi-Low poker game). Then each player receives his or her fifth, and last, card. At this point, the "bank" hands are exposed and each player's hand is compared to the specific "bank" hand, or hands, that they have elected to play against, winners are determined, and wagers are settled. The election of playing against a high rank hand, low rank hand or both ways, does not alter the strategy or selection of cards, as only the hand dealt to the player is utilized, without any replacement of cards coincident with play strategy.

U.S. Pat. No. 5,664,781 describes a method and apparatus for playing a poker-type card game. A number of different stud poker hands are dealt on a playing surface and players wager as to which will have the highest stud poker ranking. Game options include choosing the hand with the lowest rank instead of the highest rank. As each hand is fixed and there are no replacement cards, there can be no play of one hand that is influenced by the play of another hand.

U.S. Pat. No. 6,406,020 describes a method of playing a card game particularly adapted for casino wagering. The game uses one or more standard fifty-two card decks and involves a banker, a dealer and one or more players. The player has the option of wagering against a banker's high hand, low hand or both by placing an ANTE bet or bets. The dealer deals two cards to each player placing an ANTE bet and deals three cards to the banker. After viewing the dealt hand, a player has the option of surrendering his ANTE bet or bets or placing a PLAY bet or bets. Winning hands are determined by the numerical value of the cards held by the player as compared to the numerical value of the cards held by the banker. Bonus payoffs are paid to the player if the player's hand qualifies as a certain predefined high or low hand. A Jackpot to be paid for a certain defined hand may be employed. The game is played with card count, not poker ranking, although a count of twenty is described as a pair, as when special decks with only counts thereon are used.

A high-low card game in which players are dealt three cards and a dealer is dealt four cards, and hand rankings are determined according to poker values, is disclosed in U.S. Pat. No. 5,810,663 to J. Bochichio. The players' hands are compared with the dealer's hand and bets are paid or lost accordingly. The game requires the player to make an election of High or Low as follows. In a high/low card game, individual players place an ante and are dealt three cards, face down while the dealer is dealt four cards, one of which is face up and the other cards are face down. Players may then fold and forfeit their ante or they may place an additional bet. Their hand is either a high hand or a low hand against the dealer. Any three of the dealer's four cards are employed to present a high hand and any three of the dealer's cards are also employed to present a low hand. If the dealer's high hand and low hand are not of at least a predetermined rank, the respective high hand and low hand players win prescribed odds on their bet dependent upon the rank of their hand and keep their ante. If the dealer's hand is of higher rank than the hand of a player who has bet for a high hand or of lower rank than a player who has bet for a low hand and the dealer's rank was sufficient to qualify, the respective betting players lose both the ante and their bet.

U.S. Pat. No. 6,135,453 describes a method of playing a high/low poker game that includes each seated player placing a first high hand wager in a first high hand betting location and a first low hand wager in a first low hand betting location; each seated player optionally placing one or more additional wagers in one or more additional high hand or low hand betting locations; each seated player designating at least two cards or tiles selected from an initial hand as a high hand and designating at least two cards or tiles from an initial hand as a low hand; determining winners and paying wagers for the first high hand and first low hand betting locations by comparing the relative rank of the seated players' high hands and low hands, respectively; and, if a seated player placed a wager in one or more additional high hand or low hand betting locations, then determining winners and paying wagers for each additional high hand betting location and each additional low hand betting location. A banking version of a high/low poker game additionally includes the step of a dealer setting out a dealer high hand and a dealer low hand to which the player's hands will be compared. In addition, an apparatus for playing a high/low poker game includes a playing area with at least two player stations designated to provide a high hand placement location; a low hand placement location; two or more high hand betting locations; and two or more low hand betting locations. High-Low poker is played in a number of different variants. The most common variants of High-Low games are well described in "Silberstang's Encyclopedia of Games and Gambling," Cardoza Publishing, Copyright 1996, Edwin Silberstang, pages 67-72. The typical games described usually require the player to elect (often by placement of an additional wager into a common pot) whether the player will play for the High hand, the Low Hand or go Both Ways (by rearranging cards, going both High and Low in certain games).

Similarly, *The New Complete Hoyle Revised*, Morehead et al., Doubleday Press, Copyright 1991, pages 28-30 describes poker variations including High-Low games. With respect to Declarations, Hoyle states, "In many games, each player is required to declare, after the bets have been equalized in the last betting interval but before any face-down cards are exposed for the showdown, whether he is going for high, for low, or for both. He is bound by his announcement, and if he declares for high, he may not compete for low; . . . " Although methods are described for declaring the hand, there is no description of a method by which there is no declaration. This implies that "Hands speak for themselves." That is, all hands must be compared top all other hands on both a basis of High hands and on the basis of Low hands for the specific cards.

In summary, it is desired to find a game that is easy to play and also fast moving. When the player is provided with a considerable amount of participation, and additional winnings based on card combinations not related to only high hands, these games become much more strategic and enjoyable. Furthermore, a game is more exciting if a player feels anticipation and excitement from a number of different sources throughout the game.

SUMMARY OF THE INVENTION

The present technology provides a method of playing a wagering game, comprising at least the following steps: First, a player places a first wager to participate in the game. The game can be a primary game or a side bet game on a primary game. What is meant by "primary game" for purposes of the present invention is a game that the player is required to play when the player makes the wager or wagers necessary to participate in the game. What is meant by "side bet game" for purposes of the present invention is an optional wager on a game that the player is not required to make. The player has the option to play the side bet game while the player is playing the primary game. In some game formats, a player can play only the side bet game (without placing a wager on the primary game, or play the primary game without participating in the side bet wagering game.

It is less preferred in many games to allow the player to play only the side bet wagering game, without having to play the underlying game. The dealer deals to each player at least a partial hand of cards (the term "at least a partial hand" includes dealing a complete hand to a player or dealer) to each player participating in the game. The method also includes providing game rules which define a set of winning outcomes and corresponding payout odds, wherein the set of winning outcomes includes at least one predetermined high ranking hand (a hand equal to or greater than a first predetermined rank) and at least one predetermined low ranking hand (a hand equal to or less than a second predetermined rank), wherein the first predetermined rank and the second predetermined rank are not the same rank. The rules may provide the same ranking system for determining the high-ranking hands as determining the low ranking hands, or the ranking systems may be different.

Additional cards are dealt, if necessary, and/or if the rules require additional cards, to complete each player hand. If the player's hand is one of a predetermined number of winning outcomes, the player is paid a payout on the first wager for obtaining a winning outcome. In one format of play, the player does not make an election to play a high or a low hand. He simultaneously plays the same hand hoping to get a high or a low outcome with the same hand (or split hand, in the case of a pai gow poker variant) of cards, in a round of play.

In another form of the invention, the player wagers a single wager or a group of preferably non-severable wagers, that is, each and every wager is applied against both a High hand and Low hand potential for winning a high and low game that is played against a dealer. For example, one, two, three or four distinct parts are initially wagered, with each and every part potentially in play for both the High hand and Low hand payout, preferably without any election. The method comprises the steps of: a player placing a first wager to play a player hand against a dealer hand, dealing at least a partial hand of cards to each player participating in the game, dealing at least a partial hand of cards to the dealer, providing additional cards, when needed according to the game rules to complete the single player and single dealer hands, comparing the player and dealer completed hands using a predetermined set of game rules, the rules providing for at least a minimum high-ranking hand and at most a maximum low ranking hand, and paying a player a payout on the first wager for obtaining a winning outcome for player hands ranking higher than a ranking of the dealer's hand and for player hands that have a ranking at or below the maximum low ranking. The cards are inspected by the dealer (or a processor in an electronic version) and the rules determine whether the hand wins or loses playing High, Low or Both High and Low.

The games of the present invention may be implemented as live table games, video poker gaming machines, hand-held games for play, multiple player interactive wagering platform games (e.g., at a kiosk, at a bank of individual positions with a joint or individual screens for player cards, etc.), cell phone games, games downloadable from the internet, parlor games, games executed on personal computers, palm pilots, play stations and the like. Each of the above game applications is contemplated by the present invention.

DETAILED DESCRIPTION OF THE INVENTION

Figure 1:
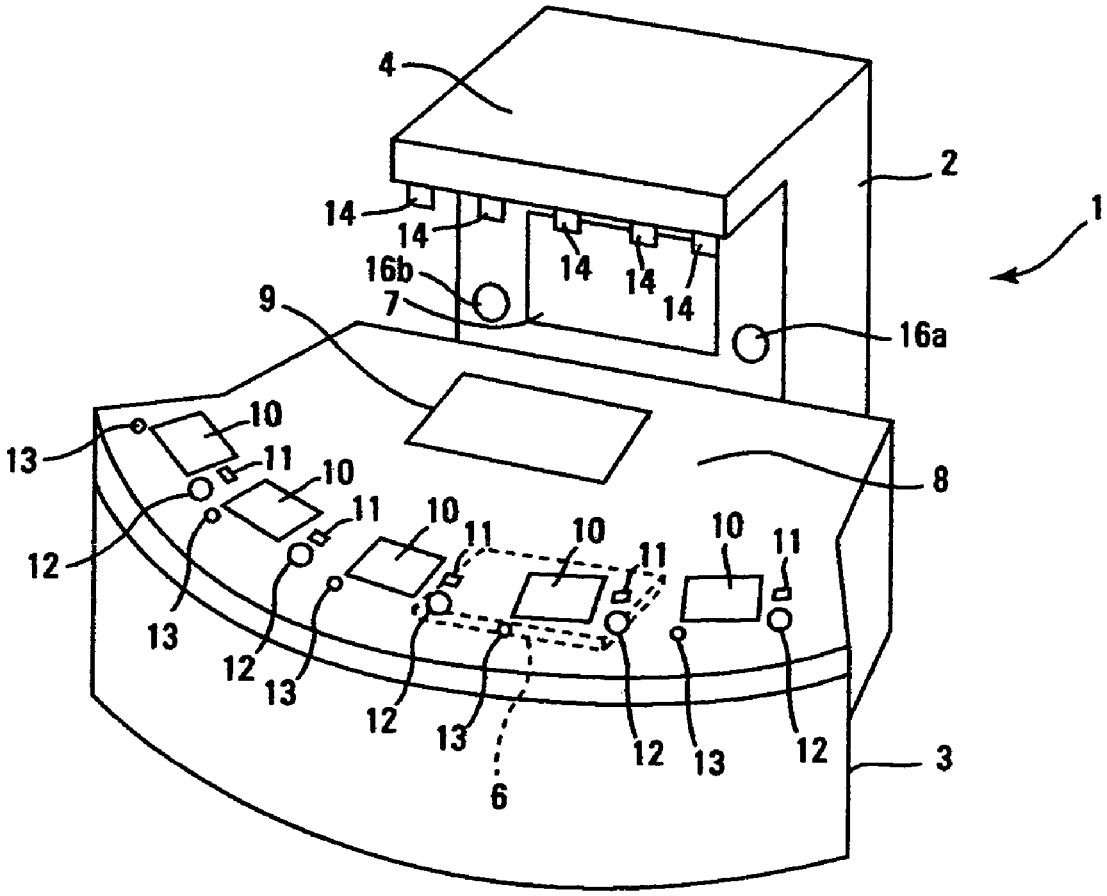
Fig. 1 Prior Art
FIG. 1 shows a perspective view of a prior art format for an automated gaming system.

The present technology provides a method of playing a wagering game, comprising at least the following steps: First, a player places a first wager to participate in the game. For purposes of this disclosure, the "game" can be a primary game or a side bet game on a primary game. What is meant by "primary game" for purposes of the present invention is a game that the player is required to play when the player makes the wager or wagers necessary to participate in the game. A "side bet game" in contrast is a game that the player can optionally play by placing a separate side bet wager. Side bet games are typically played along with the primary game, although the side bets may be resolved before, during or after resolution of the bets in the primary game. Side bet games are also typically played with all or part of the same hand of cards used to play the primary game.

The dealer deals to each player at least a partial hand of cards to each player participating in the game. The method also includes providing game rules which define a set of winning outcomes and corresponding payout odds, wherein the set of winning outcomes includes at least one predetermined high-ranking hand (a hand equal to or greater than a first predetermined rank) and at least one predetermined low-ranking hand (a hand equal to or less than a second predetermined rank), wherein the first predetermined rank and the second predetermined rank are not the same rank. The rules may provide the use of the same ranking system for determining the high-ranking hands as determining the low ranking hands, or the ranking systems may be different. For example, a game designer might select standard five-card poker rankings for both the high and low ranking system, determining that all hands above a 9 high and below a pair of 7's do not generate a payout. Winning high hands would include a royal flush a straight flush, four of a kind, full house, flush, straight, three of a kind, two pair, two of a kind (at least 7's), and winning low hands would be a 2 high, 3 high, 4 high, 5 high, 6, high, 7 high, 8 high and 9 high pay. An example of a different set of rules is for the High hand to be evaluated with standard poker ranks (e.g., at least a pair of Jacks needed to win) and the Low hand being evaluated on the total point count of a hand (e.g., using Ace=11, 2=2, J, Q, K=10), wherein if the total point count in a 5-card hand was 18 or less, there would be an award payout.

Additional cards are dealt, if necessary, to complete each player hand. If the player's hand is one of a predetermined number of winning outcomes, the player is paid a payout on the first wager for obtaining a winning outcome. The payout may pay 1:1 odds, or may pay higher odds, depending on the desired game characteristics. According to one embodiment of the invention, the player does not make an election to play a high or a low hand. He simultaneously plays the same hand hoping to get a high or a low outcome with the same hand (or split hand, in the case of a pai gow poker variant) of cards, in the same round of play.

The game rules typically identify a ranking system in which outcomes can be ranked in order of probability of occurrence, and payout odds are assigned such that less frequently occurring combinations are paid higher payouts, and more frequently occurring outcomes pay lower payouts.

Although it is not necessary, the ranking system that identifies winning high-ranking hands may be a different ranking system than that which identifies low ranking hands. For example, when the game is a five-card poker game, standard five-card poker rankings may be used to determine which hands are winning high hands. In contrast, when ranking the same hand for purposes of determining if the hand is sufficiently low to win, certain combinations of cards such as straights, flushes and straight flushes may be ignored. In one embodiment of an alternative format of the invention, only high cards, pairs, three of a kind's and four of a kind's are considered in ranking low-card hands, with the high card hands being the only ranks low enough to qualify to win a low-hand payout. In addition, the rank of the individual card is considered such that a 2 high, for example, beats a 3 high in the low hand game.

In one form of the invention, the highest-ranking low card hand is a 9 high or lower. In one non-limiting example of the invention, if the player holds a 5-6-7-8-9 of mixed suit, he or she could win the high hand game for holding a straight, and also the low hand game for holding a 9 high or lower. Under this example of game rules, flushes, straights and straight flushes are not considered in determining the low rank of a hand. According to this aspect of the invention, if the player does not hold at least a pair, the hand is ranked by identifying the high card in the hand, even if the hand would be identified as a straight, flush or straight flush in ordinary poker rankings (according to the exemplary high hand rules).

The game of the present invention is preferably played against a pay table that includes at least two sets of winning outcomes (at least one high hand outcome and at least one low hand outcome), including a hand that is typically considered a winning hand, and another hand that is typically considered a losing hand. For example, in the High hand outcome game of poker, the minimum winning hand might be a pair of 7's or better, while the maximum winning low (winning) hand is a 9 high or lower. There are many other possible ways to practice the invention. In one form of the invention, a pay table of multiple high hand combinations and at least one maximum low hand rank or value is provided, and corresponding payout odds are assigned to the various outcomes. If just one maximum low hand rank is used, all winning low hands typically pay the same payout. Alternatively, a pay table of winning low hands could be combined with a pay table of winning high hands or a minimum high hand value.

One feature of a preferred embodiment of the present invention is that no specific election or distinct (High only or Low only) wager is made in order for the player to have a chance to win the low hand or the high hand game. Players are always eligible to win the high hand and low hand games in the same round of play, and using all or part of the same hand of cards. It is also an aspect of the invention to offer a game in which the player can win both the high hand and the low hand in one round of play. This result is due to the variation in the high and low card ranking rules. In other forms of the invention, the low and high card games are evaluated against standard poker rankings, and the player can only win a high hand or a low hand, but not both.

The method of the present invention can be practiced as a three-card poker game, where standard three-card poker rankings are used on the high hands and at least one maximum low hand value (i.e., 5 or lower) is used to rank the low hand. One exemplary group of three-card poker game play methods are described in U.K. Patents 9414822 and 9426324 and in U.S. Pat. Nos. 5,685,774, 6,056,641, 6,237,916, 6,345,823, and 6,698,759 (by Webb and Snow and some or all of which are assigned to Shuffle Master, Inc., the assignee of the present invention. The content of the above-referenced three-card poker patents is herein incorporated by reference.) While playing a high and low game against a pay table (the pair plus bet), the game against the dealer (the ante bet) could be conducted under known rules, where the high hand wins, or using low hand rules, in which the lowest ranking hand wins. The low card ranking rules can be identical to the high hand ranking rules (i.e., three of a kind is higher than a pair), or the low card ranking rules can be different (i.e. straights, flushes, straight flushes, pairs and three of a kinds are ignored and only the high card is considered, or under a different set of rules, if there is no pair or better, only the high card is considered). For example, if there is no actual pair of cards (including no three-of-a-kind, two pairs, full house or four-of-a-kind), then the Low rank of the hand would be considered without regard to suits (no flushes would exist) or order of the cards (no straights would exist) for the Low hand ranking.

According to one aspect of the invention, the game is played with a betting structure similar to certain variants of poker, in which the players make a single ante bet to participate, receive fewer than all of the cards or be allowed to view fewer than all of the cards, and then make at least one raise bet to stay in the game. Additional betting rounds may be a feature of the game. After the betting steps are complete, the player receives or views the remaining cards in his hand, and the final bets are resolved. For example, the players can make one or more bets to participate in the game, and can be dealt a partial hand of cards after the first round of wagering. For example, in a three-card version of the game, the player could be dealt two cards and be allowed to view the cards before deciding to fold, losing his bet, or to make a raise bet to stay in the game. Or the player may see one or more of the dealer's cards and make his raise bet before viewing his own cards. At the conclusion of the dealing of the cards, the hands are resolved according to the predetermined high and low winning outcomes, preferably without any specific designation of the wager or election that the wager goes towards only High rankings to win or only towards a Low ranking to win.

Other betting structures could be used to implement the method of the present invention. For example, the betting structure of Let it Ride® poker, described in U.S. Pat. Nos. 5,288,081; 5,437,462; 6,273,424; and 6,334,614, the game distributed and owned by Shuffle Master, Inc. of Las Vegas, Nev. could be used in the game of the present invention. The content of the disclosures of the above-identified Let it Ride® game patents is herein incorporated by reference. In the game of Let it Ride® poker, three equal bets are placed prior to the dealer dealing each player three cards. Two community cards are dealt face-down. After the players view their partial hand, the player may elect to withdraw a first portion of the bet. The dealer then reveals a first community card. The player now has information on four out of the five cards in his or her hand. Based on this information, the player is permitted to withdraw a second portion of his bet. The third portion remains at risk. The dealer then reveals the second community card and awards payouts to players according to a pay table of high hands, and at least one low hand value, such as an 8 high or lower, for example.

Although this example of the invention provides multiple winning high hands and corresponding payout odds, and one maximum low hand value, the invention contemplates the use of multiple winning low hand values and corresponding payout odds. For example, a 4 high might pay 3:1 while a 9 high might pay 1:1 in the same form of the game. Also, the high hands could all pay even money, while specified low hands pay odds payouts.

Examples of poker-type games that use different types and numbers (3 and 5) of cards have been described above. Other poker-type games that utilize 2 cards, 4 cards, 6 cards, 7 cards, best 2 out of 3 cards, best 3 out of 4 cards, best 4 out of 5 cards, best 5 out of 6 cards, best 5 out of 7 cards, etc. and other numbers of cards are contemplated by the invention. The games can be stud poker games, draw poker, pai gow poker, blackjack or baccarat or other games that utilize a ranking scheme to determine winning game outcomes.

Although one preferred set of winning outcomes is poker rankings, other ranking systems are contemplated. For example, the cards could each be assigned a numerical value, with 1 -10 value cards having their face value, an Ace counting as a 1 in a low hand or as 11 in a high hand, and face cards counting as 10 count cards. The game rules could provide that the player play for the highest five-card composite numerical score, with a non-limiting example of a high score of 27 and above paying 2:1, a score from 26 to 16 paying 1:1, etc., and a low score of 7 or lower paying 1:1 odds. In this way, there is a range between the High count or High rank hands and the Low count or Low rank hands where there would be no payout according to the pay tables.

The game could use standard poker rankings for the high-ranking hands, and numerical hand values could be used on the low hands. Other ranking systems are contemplated, such as the use of suits, color, etc. as indications of rank.

In addition to using a standard deck or decks of cards, special decks could be used to increase, decrease or eliminate the probability of occurrence of certain hand values, adding more interest to the game. For example, a Spanish 21™ deck (with all 10 value cards removed), a canasta deck, a deck with one or more wild cards, or with one or more promotional cards, extra suits, certain suits removed, etc. could be used to practice the method of the present invention.

In another format of the invention, the player wagers a single wager or a group of preferably non-severable wagers, that is, each and every wager is applied against both a High hand potential and Low hand potential for winning a high and low game that is played against a dealer. The method comprises the steps of: a player placing a first wager to play a player hand against a dealer hand, dealing at least a partial hand of cards to each player participating in the game, dealing at least a partial hand of cards to the dealer, providing additional cards, when needed according to the game rules to complete the single player and single dealer hands, comparing the player and dealer completed hands using a predetermined set of game rules, the rules providing for at least a minimum high-ranking hand and at least a maximum low ranking hand, and paying a player a payout on the first wager for obtaining a winning outcome for player hands ranking higher than a ranking of the dealer's hand and for player hands that have a ranking at or below the maximum low ranking. The cards are inspected by the dealer (or a processor in an electronic version) and the rules determine whether the hand wins or loses playing High, Low or Both High and Low.

According to the invention, the same ranking rules or different ranking rules may be used to evaluate the high hand and the low hand games. For example, in a five-card stud poker game, the high hand rankings are standard five-card poker rankings. In one form of the invention, the low hand may be ranked by slightly different criteria. When the player holds a hand that does not actually contain a pair or better, regardless of what type of hand he holds (i.e., a straight, a flush or a straight flush), the highest card is the maximum rank of the hand for low-hand ranking purposes. For example, if the player holds a 9-8-7-6-5 unsuited, he will qualify for a high hand odds payoff for a straight, and will also qualify for a winning low hand with a 9 high or lower. Normally, the player will win the high or low bet, but not both, unless there is a bonus or rule that allows the hand to be played both ways, rather than just being awarded the highest or lowest payout possible from the dual reading of the hand.

The game can be played as a single hand game, or a double hand game. For example, the game could be a 2, 3, 4, 5, 6, 7 or more card poker game, or a 7-card Pai Gow poker game. The game could be played according to baccarat rules where the hit and stand rules are fixed, the 10 value cards count as zero, etc. and a payout could be provided for the highest low-ranking hand or lower, i.e. a 5 or lower. The method could also be used in the game of blackjack, for example, where the player's hand count at the point of busting or standing is compared to a maximum low card value, of 12 or lower, for example. The method could even be used in the game of war, where a bonus amount is paid to a player who receives certain high-ranking hands, such as a 9 or better, and a low-ranking card, such as a 3 or lower. The betting structure can be modified so that the player has one or more opportunities to fold out of the game or make an additional raise bet. The betting structure could require the player to place multiple bets, but allow the players to withdraw a portion or number of the initial multiple bets during game play. The betting structure could be further modified so that if the player withdraws a bet, the house is permitted to sweep another bet, but allow the player to continue to play the game. In one example of the invention, the betting structure is similar to Let it Ride® poker except that there are three equal bets and a fourth bet that is twice the value of bets 1, 2 or 3. The player is given partial information on his or her hand, and can withdraw bet one, but stay in the game. Upon receiving additional (but less than complete) information about the composition of the hand, the player can withdraw bet number 2 or leave it in the game. If the bet is withdrawn, bet three is swept by the house. Bet four always stays in play.

The game can also be played as a draw poker game, where the player has opportunities to withdraw and replace cards. For example, the player might receive 5 cards in a five-card draw poker game and under the rules, be allowed to discard and draw up to five additional cards or allowed to discard and receive a maximum number of cards less than 5 (e.g., 1, 2, 3 or 4 cards). The game can also involve multiple betting steps where the player must either make additional bets or fold out of the game.

One important aspect of the preferred technology being described is the format where the player, under the game rules, can win high hands or low hands on the same wager, and do so without making a decision, election or special wager on which hand to play. Although the game is best suited for a game in which the player does not draw and discard, the method can be applied to that type of game also.

The games of the present invention may be implemented as live table games, television or cable game show games, video poker gaming machine platforms, hand-held games for play, multiple player interactive wagering platform games (with kiosk formats, single player screens, community screens, and/or banks of seats for players with a common dealer screen), cell phone games, games downloadable from the internet, parlor games, games executed on personal computers, palm pilots, play stations and the like. Each of the above game applications is contemplated by the present invention.

A gaming system that can be used to practice the method of the present invention comprises a table and a dealer "virtual" video display system positioned for view by players seated at the table. The table may seat at least two players up to the amount of players that can be configured about the table and have a view of the dealer video display system. Typically each gaming system will have at least four player available positions, with space determinations considered as to whether there would be 4, 5, 6 or 7 player positions. It is possible to have a completely circular dealer display (e.g., holographic display in a cylindrical centerpiece) and have players distributed around the entire periphery, but this is too dissimilar to standard play arrangements and could slow the game down, as play should approximate that of a live game, with players playing in sequence. A surface of the table will include a generally continuous display surface for showing all player hands, community cards, dealer hands and any other cards used to play the game for any purpose, and, where there are touch screen player controls, for displaying the player touch screen controls. A majority of the table surface comprises a video monitor in one example of the invention. Where there are no touch screen controls, the table surface may include player control panels at each player station near the continuous display surface. The use of a continuous display surface offers some significant advantages in simulating or recreating a standard card table surface. Cards may be readily viewed by other players at a table, which is standard in table games and adds to player enjoyment. Individual monitors, especially where slanted towards the individual players make such table-wide card reading difficult. The use of the full screen (continuous) display also allows for better animation to be provided, such as displaying virtual images of cards moving to the player and "virtual" chips being placed on the table when wagers are indicated. For purposes of this disclosure, the term "virtual" means a graphical video representation of a real object or person, such as a dealer, cards and chips, for example.

The individual player positions preferably have a separate intelligence at each player position that accepts player input and communicates directly with a game engine (main game computer or processor). The intelligence is preferably an intelligent board that can process information. For purposes of this disclosure the term "intelligent" refers to the ability to execute code, either provided in the form of software or hardware circuits. Such processing may at least comprise some of signal converting (e.g., signals from player card readers, credit deposit, currency readers, coin readers, touch screen signals, control panel signals) into a signal that can be included in an information packet and interpreted by the main game computer when the signal is sent. Communication between the intelligence at each player position is direct to the main game computer and may be by self-initiated signal sending, sequenced polling by the main game computer (e.g., each position communicates directly to the main game computer in turn), timed communication, or any other order of communication that is direct between the intelligence and the main game computer.

One preferred form of communication between the main game computer and player station computers is by means of self-initiated signal sending. There is essentially a single main game computer that contains video display controls and programs for both the dealer display and the table top display, audio controls and programs, game rules (including storage of multiple games if intended to be available on the machine), random number generator, graphic images, game sequence controls, security systems, wager accounting programs, external signaling and audit functions, and the like. In other forms of the invention, the above functions are divided between a main processor and one or more additional processors. The intelligence at each player position speeds up the performance of all aspects of the game by being able to communicate directly with the main game computer and being able to process information at the player position rather than merely forwarding the information in raw form to the main game computer. Processing player information at player positions frees up resources for use by the main processor or processors.

A card game system may also include a suitable data and control processing subsystem that is largely contained within a main control module supported beneath the tabletop. The control and data processing subsystem includes a suitable power supply for converting alternating current from the power main as controlled by a main power switch. The power supply transforms the alternating line current to a suitable voltage and to a direct current supply. Power is supplied to a power distribution and sensor/activity electronics control circuit. Commercially available power switching and control circuits may be provided in the form of a circuit board which is detachable, and plugs into a board receptacle of a computer mother board or an expansion slot board receptacle. A main game controller motherboard may include a central microprocessor and related components well-known in the industry as computers using Intel brand Pentium® microprocessors and related memory or intelligence from any other manufacturing source. A variety of different configurations and types of memory devices can be connected to the motherboard as is well known in the art. Of particular interest is the inclusion of two flat panel display control boards connected in expansion slots of the motherboard. Display control boards are each capable of controlling the images displayed for the dealer video display and for each of the player position display areas on the continuous display screen on the table and other operational parameters of the video displays used in the gaming system. More specifically, the display control boards are connected to player bet interfaces circuits for the player stations. This arrangement also allows the display control boards to provide necessary image display data to the display electronic drive circuits associated with the dealing event program displays and the dealer display.

The motherboard and/or the individual player intelligent boards also includes a serial port that allows stored data to be downloaded from the motherboard to a central casino computer or other additional storage device. In one example, each player board communicates directly with the casino computer system. This allows card game action data to be analyzed in various ways using added detail, or by providing integration with data from multiple tables so that cheating schemes can be identified and eliminated, and player tracking can be maintained. Player performance and/or skill can be tracked at one table or as a compilation from gaming at multiple tables, as by using Bloodhound™ security software marketed by Shuffle Master, Inc., which may be incorporated into this automated gaming system. Additionally, player hand analysis can be performed. The motherboard and/or individual player intelligent boards may also have a keyboard connection port that can be used to connect a larger format keyboard to the system to facilitate programming and servicing of the system.

Although the preferred system shown does not require features illustrated for receiving automated player identification information, such features can alternatively be provided. Card readers such as used with credit cards, or other identification code reading devices can be added in the system to allow or require player identification in connection with play of the card game and associated recording of game action by one of the processors. Such a user identification interface, for example a card reader located at each player station, can be implemented in the form of a variety of magnetic card readers commercially available for reading user-specific identification information. The user-specific information can be provided on specially constructed magnetic cards issued by a casino, or magnetically coded credit cards or debit cards frequently used with national credit organizations such as VISA, MASTERCARD, AMERICAN EXPRESS, casino player card registry, banks and other institutions. The information could also be provided on other writable media, such as an RFID chip with writable memory, or bar coding, as just a few examples.

Alternatively, it is possible to use so-called smart cards to provide added processing or data storage functions in addition to mere identification data. For example, the user identification could include coding for available credit amounts purchased from a casino. As further example, the identification card or other user-specific instrument may include specially coded data indicating security information such as would allow accessing or identifying stored security information which must be confirmed by the user after scanning the user identification card through a card reader. Such security information might include such things as file access numbers which allow the central processor to access a stored security clearance code which the user must indicate using input options provided on displays using touch screen displays. A still further possibility is to have participant identification using a fingerprint image, eye blood vessel image reader, or other suitable biological information to confirm identity of the user that can be built into the table. Still further it is possible to provide such participant identification information by having the pit personnel manually code in the information in response to the player indicating his or her code name or real name. Such additional identification could also be used to confirm credit use of a smart card or transponder. All or part of the functions dedicated to a particular player station are controlled by the player station intelligence in one form of the invention. Additionally, each player station intelligence may be in communication with a casino accounting system.

It should also be understood that the continuous screen can alternatively be provided with suitable display cowlings or covers that can be used to shield display of card images from viewing by anyone other than the player in games where that is desirable. This shielding can also be effected by having light-orientation elements in the panel, and some of these light-orientation elements are electronically controllable. In this manner, the processor can allow general viewing of cards in games where that is desirable or tolerated, and then alter the screen where desired. These types of features can be provided by nanometer, micrometer or other small particulate or flake elements within a panel on the viewing area that are reoriented by signals from the processor. Alternatively, liquid crystal or photo chromatic displays can be used to create a screening effect that would allow only viewers at specific angles of view from the screen area to view the images of cards. Such an alternative construction may be desired in systems designed for card games different from blackjack, where some or all of the player or dealer cards are not presented for viewing by other participants or onlookers. Such display covers or cowlings can be in various shapes and configurations as needed to prevent viewing access. It may alternatively be acceptable to use a player-controlled switch that allows the display to be momentarily viewed and then turned off. The display can be shielded using a cover or merely by using the player's hands. Still further it is possible to use a touch screen display that would be controlled by touch to turn on and turn off. Similar shielding can be used to prevent others from viewing the display.

A review of the figures will assist in a further understanding of the invention.

FIG. 1 shows a fully automated gaming table 1 of the prior art, as disclosed in U.S. Patent Application 2003/0199316. The system 1 comprises a vertical upright display cabinet 2 and a player bank or station cluster arrangement 3. The vertical display cabinet 2 has a viewing screen 7 on which images of the virtual dealer are displayed. The top 8 of the player bank arrangement 3 has individual monitor screens 10 for each player position, as well and tabletop inserted coin acceptors 11, and player controls 12 and 13. There is a separate and larger dealer's hand screen 9 on which dealer cards are displayed in a format large enough for all players to view. Speakers 16*a* and 16*b* are provided for sound transmission and decorative lights 14 are provided.

Figure 2:
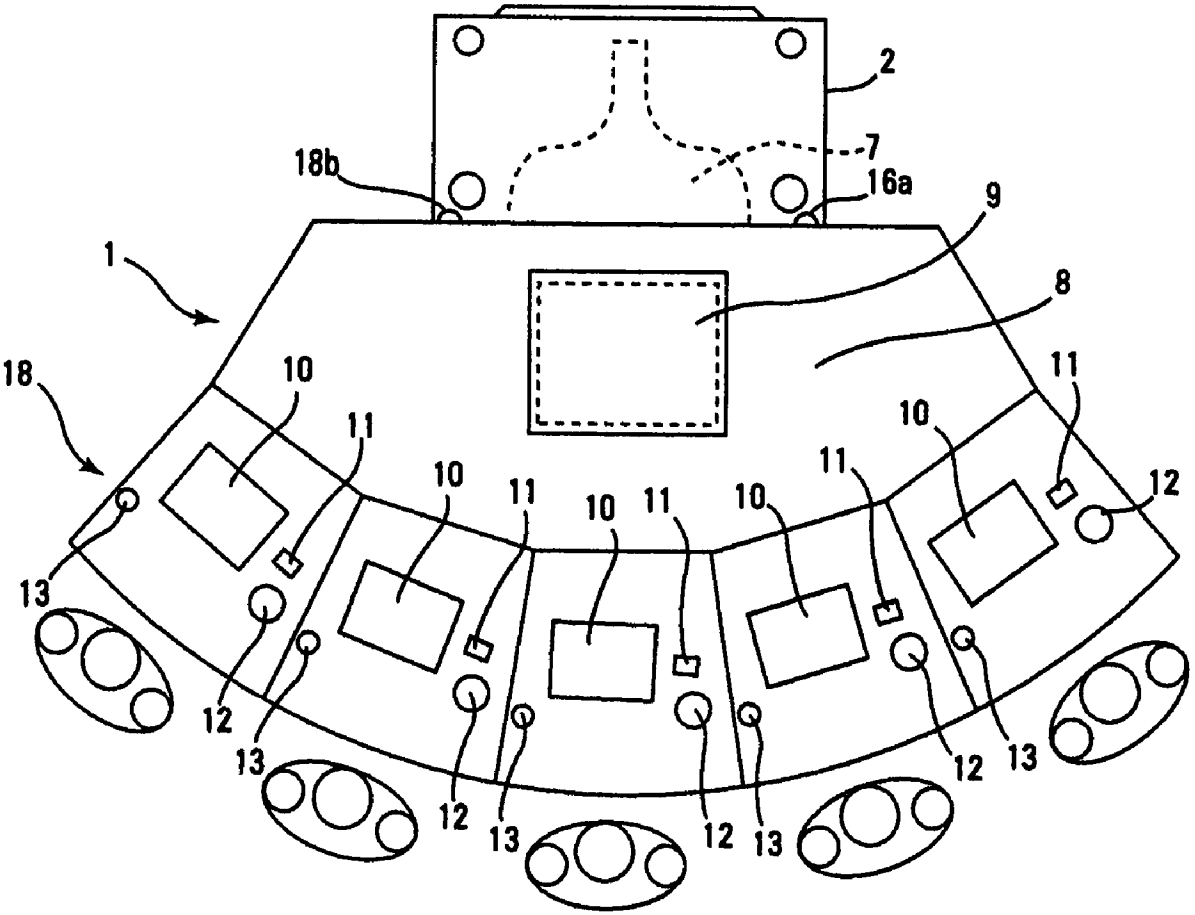
Fig. 2 Prior Art
FIG. 2 shows an overhead view of a prior art format for an automated gaming system.
Figure 3:
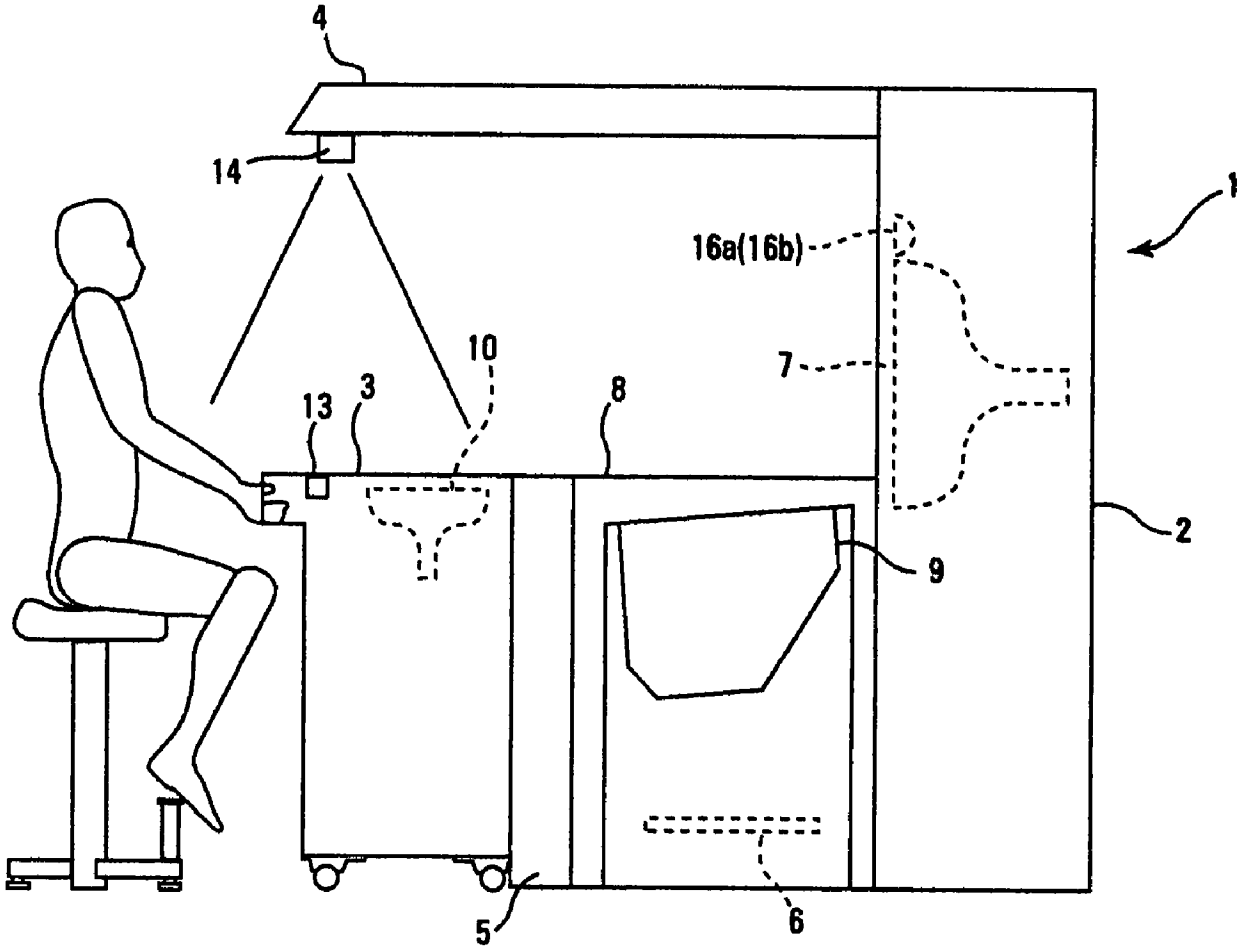
Fig. 3 Prior Art
FIG. 3 shows a side view of a prior art format for an automated gaming system.

FIG. 2 shows an overhead view of the same prior art automated gaming system 1 with the viewing screen 7 shown more clearly as a CRT monitor. It can also be seen that each player position has to form an arc cut into the semicircular player seating area 18. FIG. 3 shows a side view of the same prior art automated gaming system of FIGS. 1 and 2 where the orientation of the three different types of CRT monitors 7, 9 and 10 are shown.

Figure 4:
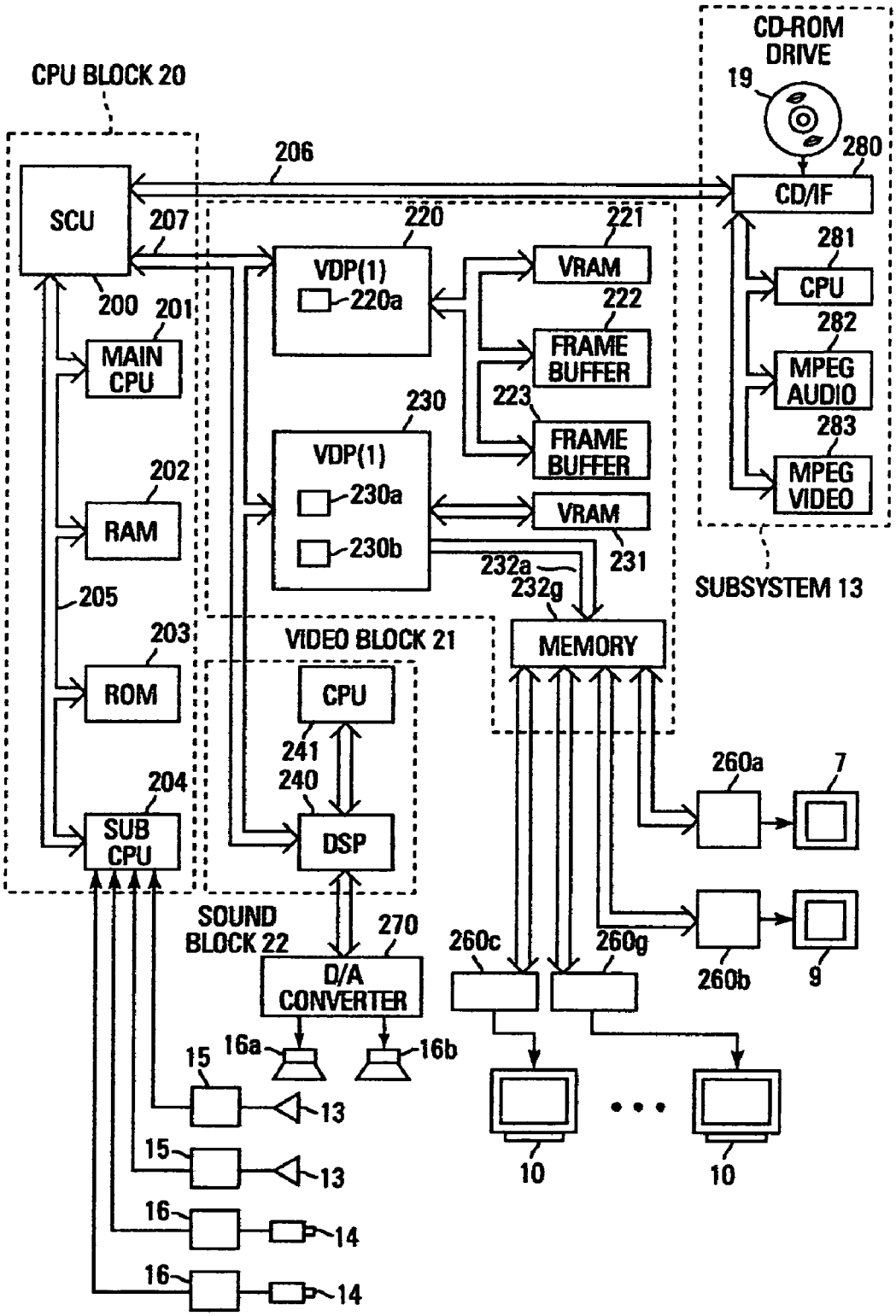
Fig. 4 Prior Art
FIG. 4 shows a block schematic of the electronic configuration of a prior art animated gaming system.

FIG. 4 shows the schematic circuitry of a prior art automated system as disclosed in 2003/0199316. FIG. 4 is a block diagram of processing circuitry in the game device of FIG. 1. The game device housing comprises a CPU block 20 for controlling the whole device, a picture block 21 for controlling the game screen display, a sound block for producing effect sounds and the like, and a subsystem for reading out CD-ROM.

The CPU block 20 comprises an SCU (System Control Unit) 200, a main CPU 201, RAM 202, RAM 203, a sub-CPU 204, and a CPU bus 205. The main CPU 201 contains a math function similar to a DSP (Digital Signal Processing) so that application software can be executed rapidly.

The RAM 202 is used as the work area for the main CPU 201. The RAM 203 stores the initialization program used for the initialization process. The SCU 200 controls the busses 205, 206 and 207 so that data can be exchanged smoothly among the VEPs 220 and 230, the DSP 241, and other components.

The SCU 200 contains a DMA controller, allowing data (polygon data) for character(s) in the game to be transferred to the VRAM in the picture block 21. This allows the game machine or other application software to be executed rapidly. The sub-CPU 204 is termed an SMPC (System Manager & Peripheral Control). Its functions include collecting sound recognition signals from the sound recognition circuit 15 or image recognition signals from the image recognition circuit 16 in response to requests from the main CPU 201. On the basis of sound recognition signals or image recognition signals provided by the sub-CPU 204, the main CPU 201 controls changes in the expression of the character(s) appearing on the game screen, or performs image control pertaining to game development, for example. The picture block 21 comprises a first VPD (Video Display Processor) 220 for rendering TV game polygon data characters and polygon screens overlaid on the background image, and a second VDP 230 for rendering scrolling background screens, performing image synthesis of polygon image data and scrolling image data based on priority (image priority order), performing clipping, and the like. The first VPD 220 houses a system register 220*a*, and is connected to the VRAM (DRAM) 221 and to two frame buffers 222 and 223. Data for rendering the polygons used to represent TV game characters and the like is sent to the first VPD 220 through the main CPU 220, and the rendering data written to the VRAM 221 is rendered in the form of 16- or 8-bit pixels to the rendering frame buffer 222 (or 223). The data in the rendered frame buffer 222 (or 223) is sent to the second VDP 230 during display mode. In this way, buffers 222 and 223 are used as frame buffers, providing a double buffer design for switching between rendering and display for each individual frame. Regarding information for controlling rendering, the first VPD 220 controls rendering and display in accordance with the instructions established in the system register 220*a* of the first VPD 220 by the main CPU 201 via the SCU 200.

The second VDP 230 houses a register 230*a* and color RAM 230*b*, and is connected to the VRAM 231. The second VDP 230 is connected via the bus 207 to the first VPD 220 and the SCU 200, and is connected to picture output terminals Voa through Vog through memories 232*a* through 232*g* and encoders 260*a* through 260*g*. The picture output terminals Voa through Vog are connected through cables to the display 7 and the satellite displays 10.

Scrolling screen data for the second VDP 230 is defined in the VRAM 231 and the color RAM 230*b* by the CPU 201 through the SCU 200. Information for-controlling image display is similarly defined in the second VDP 230. Data defined in the VRAM 231 is read out in accordance with the contents established in the register 230*a* by the second VDP 230, and serves as image data for the scrolling screens that portray the background for the character(s). Image data for each scrolling screen and image data of texture-mapped polygon data sent from the first VPD 220 is assigned display priority (priority) in accordance with the settings in the register 230*a*, and the final image screen data is synthesized.

Where the display image data is in palette format, the second VDP 230 reads out the color data defined in the color RAM 230*b* in accordance with the values thereof, and produces the display color data. Color data is produced for each display 7 and 9 and for each satellite display 10. Where display image data is in RGB format, the display image data is used as-is as display color data. The display color data is temporarily stored in memories 232*a*-232*f* and is then output to the encoders 260*a*-260*f*. The encoders 260*a*-260*f* produce picture signals by adding synchronizing signals to the image data, which is then sent via the picture output terminals Voa through Vog to the display 7 and the satellite displays 10. In this way, the images required to conduct an interactive game are displayed on the screens of the display 7 and the satellite displays 10.

The sound block 22 comprises a DSP 240 for performing sound synthesis using PCM format or FM format, and a CPU 241 for controlling the DSP 240. Sound data generated by the DSP 240 is converted into 2-channel sound signals by a D/A converter 270 and is then presented to audio output terminals Ao via interface 271. These audio output terminals Ao are connected to the input terminals of an audio amplification circuit. Thus, the sound signals presented to the audio output terminals Ao are input to the audio amplification circuit (not shown). Sound signals amplified by the audio amplification circuit drive the speakers 16*a* and 16*b*. The subsystem 23 comprises a CD-ROM drive 19*b*, a CD-I/F 280, and CPU 281, an MPEG-AUDIO section 282, and an MPEG-PICTURE section 283. The subsystem 23 has the function of reading application software provided in the form of a CD-ROM and reproducing the animation. The CD-ROM drive 19*b* reads out data from CD-ROM. The CPU 281 controls the CD-ROM drive 19*b* and performs error correction on the data read out by it. Data read from the CD-ROM is sent via the CD-I/F 280, bus 206, and SCU 200 to the main CPU 201 that uses it as the application software. The MPEG-AUDIO section 282 and the MPEG-PICTURE section 283 are used to expand data that has been compressed in MPEG (Motion Picture Expert Group) format. By using the MPEG-AUDIO section 282 and the MPEG-PICTURE section 283 to expand data that has been compressed in MPEG format, it is possible to reproduce motion picture. It should be noted herein that there are distinct processor for the CPU block, video block, sound block, CD-ROM drive and Memory with their independent PCU's. This requires significant computing power and still has dumb (no intelligence) player input components.

Figure 5:
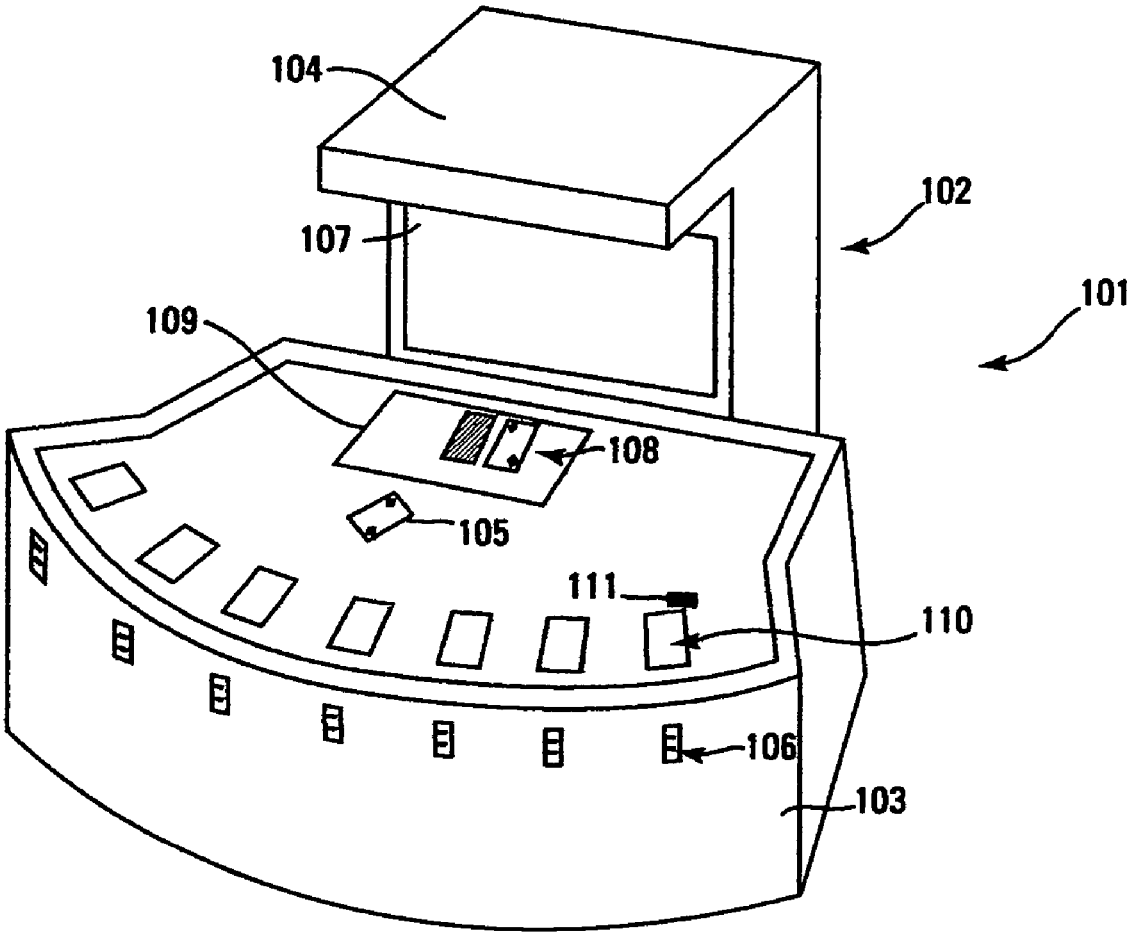
FIG. 5 shows a perspective view of a format for an automated gaming system according to the present invention.

FIG. 5 shows an example of an automated table system 101 useful to practice the game play methods of the present invention. The system 101 has an upright dealer display cabinet 102 with a top 104 and the dealer viewing screen 107 which may be any form of display screen such as a CRT, plasma screen, liquid crystal screen, LED screen or the like. The player bank arrangement 103 has a continuous display screen 109 on which images of cards being dealt 105, dealer's cards 108, bets wagered 111 and touch screen player input functions 110 are displayed. Other player input functions may be provided on a panel 106 which might accept currency, coins, tokens, identification cards, player tracking cards, ticket in/ticket out acceptance, and the like.

Figure 6:
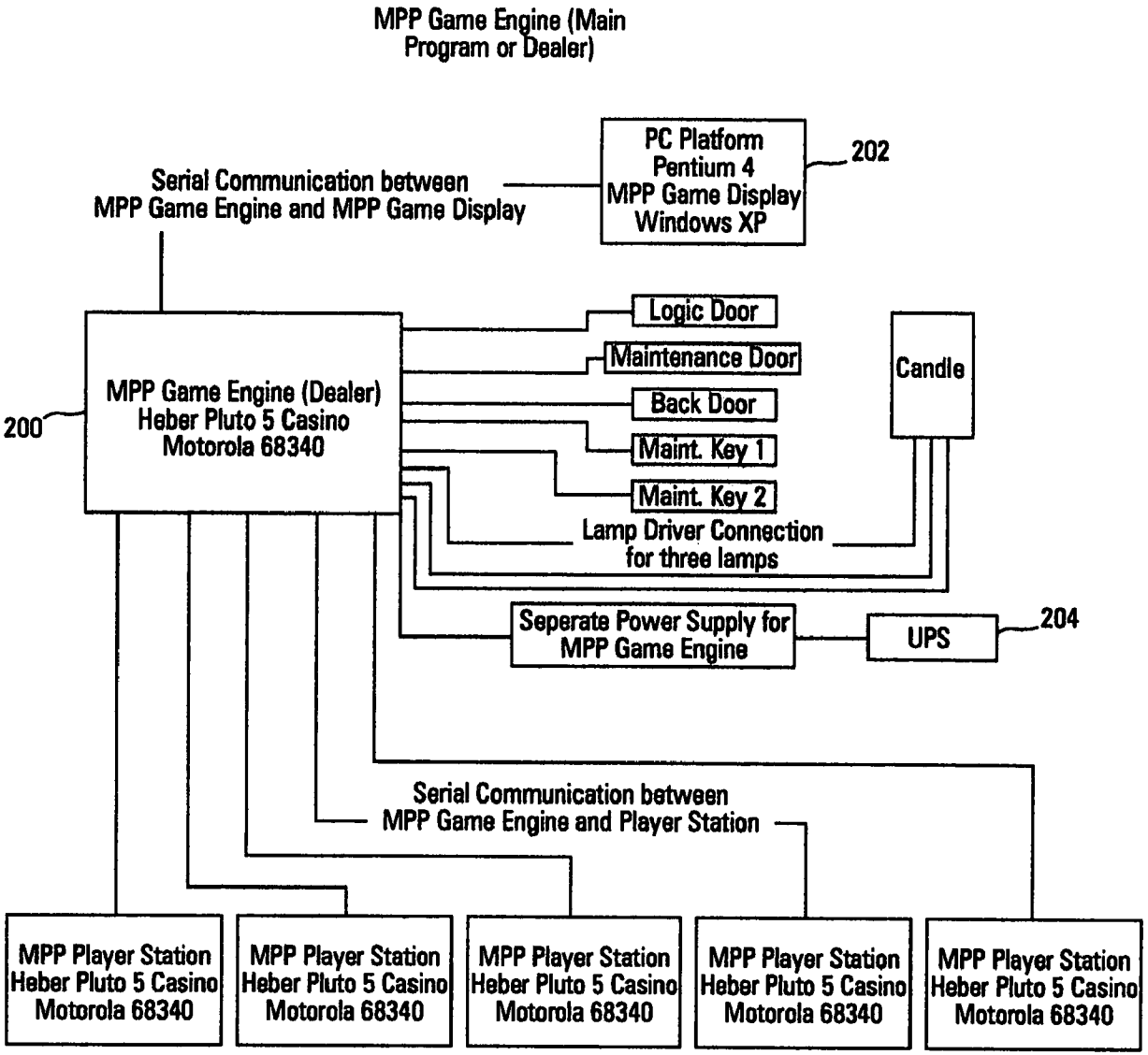
FIG. 6 shows a frontal view of a gaming engine useful in the practice of the present invention.

FIG. 6 shows an electronic/processor schematic for a MultiPlayer Platform (MPP) gaming system according to the presently described. The MPP Game engine (dealer) comprises a Heber Pluto 5 casino game board 200 (Motorola 68340 board) operating off the PC Platform Pentium® 4 MPP Game Display processor 202. The game display processor operates on a Windows XP platform. The respective subcomponents on the Pentium 4 processor are labeled to show the apportionment of activity on the motherboard and the component parts added to the board. As is shown, the game engine has an Uninterruptible Power Supply 204. The game display processor directs activity on the Speakers, directs activities onto the MPP Game Service panel, and the Plasma Monitor Card Table display. It is important to note that all communications are direct from the game display processor, freeing up resources available to the game engine processor.

Figure 7:
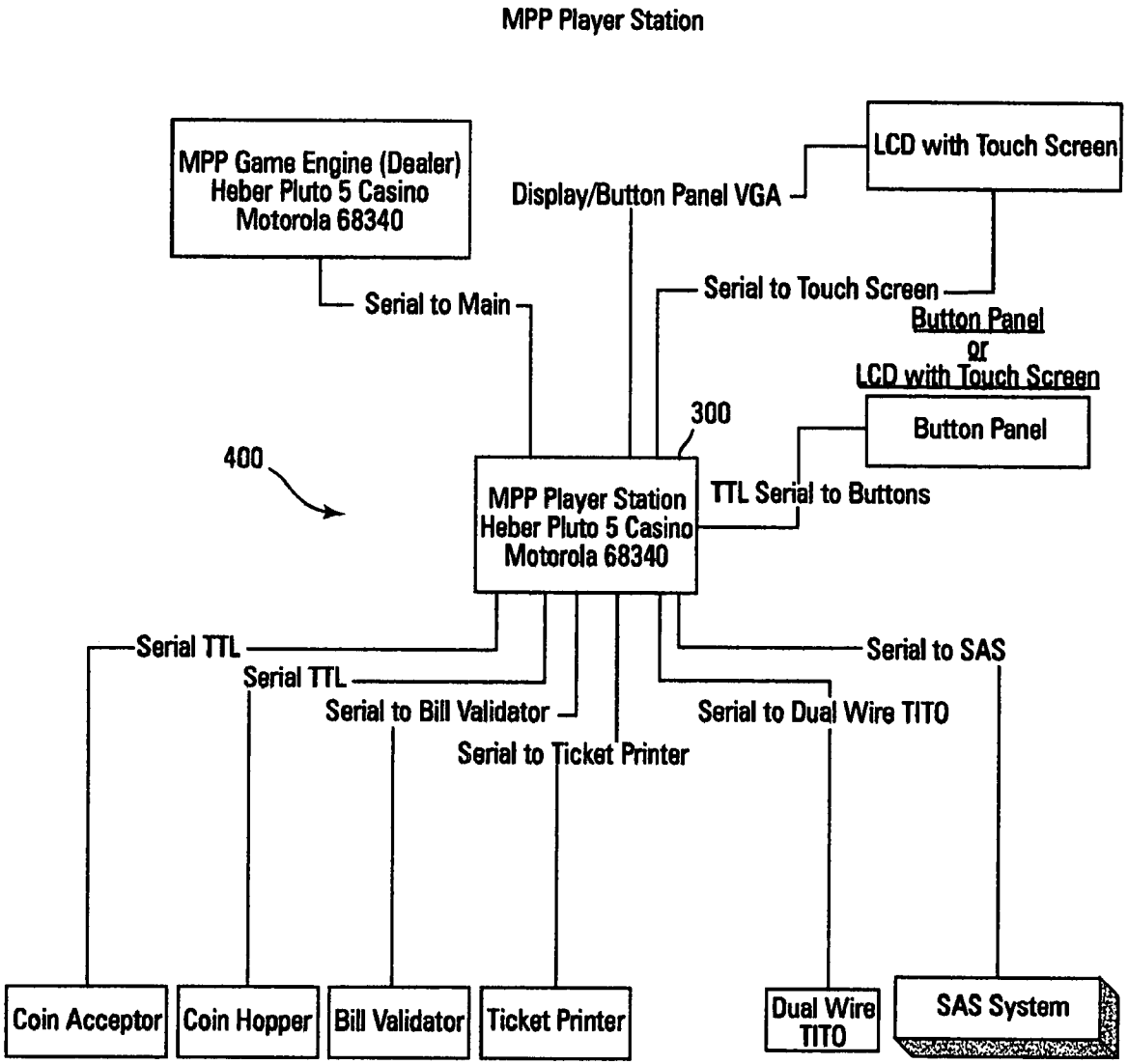
FIG. 7 shows a schematic of a player station useful in the practice of the present invention.

FIG. 7 shows the electronic/processing schematics of the MPP Player Station Intelligence board (Heber Pluto 5 Casino, Motorola 68340), each of which player stations (one for each player position) is in direct connection to the MPP Game Engine (Dealer), which is in turn directly connected to the PC Platform. (not shown in this Figure). Each Intelligence board receives information for all player input systems specific to that player station, such as the shown Coin Acceptor, Coin Hopper, Bill validator, Ticket Printer, Touch Screen and/or Display Button Panel, Dual Wire Ticket-in-Ticket-Out Printing and SAS System (SAS is one exemplary standard communications protocol used by a number of casinos central computer systems.) A significant benefit resides in the use of the independent Intelligence boards at each player position being in direct communication with the MPP Game Engine 300, as opposed to each individual player position button panel being dead or inactive until authorized by the main game processor, as previous automated gaming systems were constructed.

The above-described architecture is also an improvement in providing a system with not only the intelligence at each player position, but also in redistributing processing capability for functions among various processing components within the gaming system. In one architectural format, all functions of the gaming engine, except for the player localized intelligence functions, are consolidated into a single PC (e.g., the Pentium 4 shown in the Figures). This would include all game functions, player video functions, dealer video functions, dealer audio functions, security, central reporting (to a casino's central computer, for example), currency and debit functions, alarm functions, lighting functions, and all other peripherals on the system, except for the localized player functions. Alternatively, all functions requiring communication with the casino's main computer system are located on the player station intelligent boards. In this system, the main game processor would talk directly with the player intelligent boards, preferably in the same novel communication format described below.

Figure 8:
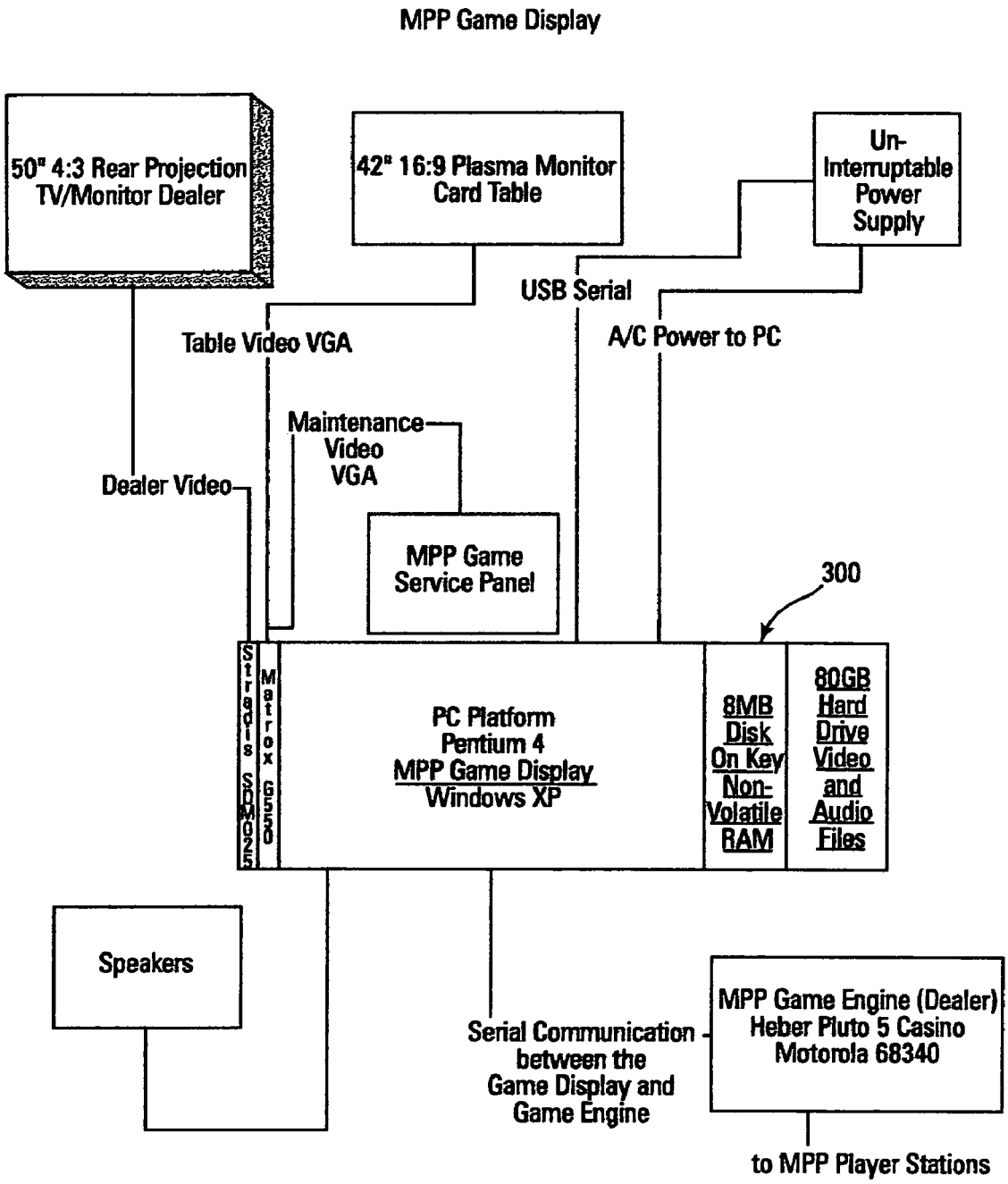
FIG. 8 shows a schematic of a preferred embodiment of a game display useful in the practice of the present invention.

An alternative system is shown in FIGS. 6, 7 and 8, where there is a dealer engine processor intermediate the main game PC and the Player intelligent boards. Both systems are a distinct improvement over the prior art, but with the higher power available for PC's, and with the ease of programming a PC as opposed to an embedded system, the consolidation of the game functions and the ability of the main game engine to communicate with each of the player positions is enabled. As shown in FIG. 8, the Game display processor 300 is preferably a Pentium® 4 PC and is separate from the main processor. With the player intelligent boards, the main game PC can receive packets of information from each player station as events occur rather than having to poll each player position on a regular basis 100 times to gain the specific information for each player input that may be made.

A description of the Heber Board, (an exemplary board that can be used as a player station processor and/or game engine processor 16) a commercially available intelligent processing board is as follows. The Heber Board is known for its reliability and flexibility, especially for the Pluto 5 family of gaming products. The Pluto 5 is the controller of choice for the global gaming industry. Flexibility comes from a set of features built into the Pluto 5 (Casino) controller, and from the choice of optional add-on boards that can be used to adapt the Pluto family to best suit individual applications. In the area of interfacing, there are three distinct boards, each of which serves a particular function in helping the Pluto 5 to connect with the world outside:

RS485 Board

RS485 is an industrial-grade board for linking multiple systems in unforgiving circumstances for centralized information gathering. The Heber RS485 board is fully opto-isolated to provide complete circuit safety when used within electrically noisy environments. The RS485 board uses a single RS232 connection to the Pluto 5 board and all necessary power is also derived through this link. Two header connectors may be provided for the RS485 channel to allow daisy chain connections between multiple systems.

HII/ccTalk Board

This board specializes in communicating with industry standard note/coin acceptors and payout hoppers. Equipped with dual communication channels, each port is configurable to use either the HII format to connect with Mars® coin/note acceptors or the ccTalk format for Money Controls® hoppers. Both channels are controlled via a single RS232 connection to the Pluto 5 board and all necessary power is also derived through this link. The Heber FastTrack™ package contains modular library functions for passing information via these channels.

Four Channel Relay Board

The relay board allows control of medium- to high-level loads such as solenoids, without risk of damage or interference to the Pluto 5 circuitry. Four power-switching channels are available with absolute isolation from the Pluto 5 control signals. Each relay is capable of switching direct or alternating currents of up to 7 A at a maximum voltage of 250V.

Like the Pluto 5 board itself, its modular options have been used extensively so that their designs are fully developed and entirely stable. The options that are specified are consistently provided in mass quantities. As with all Pluto products, programming for the modular options is straightforward. This is enhanced with the use of the Pluto 5 Enhanced Development Kit and also the FastTrack™ package. Between them, these kits contain all of the low level and high level programming tools and library functions needed for gaming applications. These systems can be provided through a Pluto 5 Enhanced Development Kit datasheet 80-15353-7 (Heber Limited, Belvedere Mill, Chalford, Stroud, Gloucestershire, GL6 8NT, UK Tel: +44 (0) 1453 886000 Fax: +44 (0) 1453 885013 www.heber.co.uk. Specifications for the various boards are identified below.

RS485 Interface

Host Interface
- RS232 connection to Pluto 5/Pluto 5 Casino
- All power provided via RS232 link from host system Communication Port
- Dual four-way Molex 0.1" KK headers for daisy chaining purposes Dimensions
- 80×61 mm (3.14×2.4")

Part Number
- Opto-isolated RS485 board 01-14536-2

HII/ccTalk Interface

Host Interface
- RS232 connection to Pluto 5/Pluto 5 Casino
- All power provided via RS232 link from host system Communication Port
- Single or dual 10 way header connectors Dimensions
- 101.6×69.85 mm (4×2.8")

Part Number
- Dual channel HII/ccTalk board 01-16171-2

Four Channel Relay Board

Host Interface
- Connection to Pluto 5/Pluto 5 Casino via ribbon cable using four standard output lines
- All power provided via ribbon cable link from host system Switching Capabilities
- Up to 250V AC or DC @ 7 A maximum per channel Dimensions
- 80×61 mm (3.14×2.4")

Part Number
- Four channel relay board 01-15275-1
80-16949-1

One proposed hardware configuration uses a "satellite" intelligent processor at each player position. The player station satellite processor is substantially the same as the primary game engine processor, a Heber Pluto 5 Casino board. The satellite processors receive instruction from the primary game engine but then handle the communications with player station peripherals independently. Each satellite processor communicates with only the peripherals at the same player station. Thus each player station has a dedicated satellite processor communicating with only the peripherals at the same player station and with the casino's central computer system. The peripherals are, but not limited to: Slot accounting Systems, Bill Validator, Ticket Printer, Coin Acceptor, Coin Hopper, Meters, Button panel or LCD touch screen and various doors and keys.

The satellite processors run proprietary software to enable functionality. The player station software is comprised of two modules, the first being an OS similar to the game engine Operating System and the second being station software that handles peripheral communications. The software may be installed on EPROMs for each satellite processor. The primary method of communication between the satellite processors and the primary game engine is via serial connectivity and the previously described protocol. In one example, information packets are prepared by the satellite processors and are sent to the game engine processor on the happening of an event.

The proposed game engine provides communication to the player stations to set the game state, activate buttons and receive button and meter information for each player station. Communication is via a serial connection to each of the stations. The new protocol for communication between the game engine, game display and player stations is an event driven packet-for-packet bi-directional protocol with Cyclic Redundancy Check (CRC) verification. This is distinguished from the Sega system that used continuous polling. This communication method frees up resources in the same engine processor because the processor no longer needs to poll the satellites continuously or periodically.

The new protocol uses embedded acknowledgement and sequence checking. The packet-for-packet protocol uses a Command Packet, Response Packet and a Synchronization Packet as illustrated below. The protocol uses standard ASCII characters to send data and a proprietary verification method.

Format of Command Packet

| STX | SEQ | DATA LENGTH | DATA | CRC-16 | ETX |
|---|---|---|---|---|---|
| 1 | 1 | 3 | 3-999 | 5 | 1 |

Format of Response Packet

| STX | SEQ | DSP | PRV | ETX |
|---|---|---|---|---|
| 1 | 1 | 1 | 1 | 1 |

Format of Synchronization Response Packet

| STX | MTS | MRS | ETX |
|---|---|---|---|
| 1 | 1 | 1 | 1 |

Legend For Figures

| | |
|---|---|
| STX | Start of Packet Character |
| SEQ | Sequence # (Cycles from '0' thru '9') |
| LEN | Length of Data Area ('003' thru '999') |
| DATA | ASCII Data Fields Separated with '\|' Character |
| CRC | CRC-16 Value ('0000' thru '65535') Cyclic Redundancy Check |
| ETX | End of Packet Character |
| DSP | Disposition Code ('A' ACK, 'N' NAK, or 'I' Invalid Sequence) |
| PRV | Sequence Number of Last ACK'ed Packet (0 thru 9) |
| MTS | Main's Current Transmit Sequence Number |
| MRS | Main's Current Receive Sequence Number |

The Command Packet and Response Packet are used during primary game communications. The protocol uses redundant acknowledgement. For example: The packet is initially acknowledged when first received by the recipient. The same recipient will resend anther acknowledgement in the next communication. This second acknowledgement is the 'PRV' data in the response packet.

The communications between the Game Engine and the Player Station intelligence is preferably a transaction-based protocol. Either device can start a transaction, which is why it is essential that there be an intelligent board at each player position. All packets of information may be sent in any acceptable format, with ASCII format preferred as a matter of designer choice. All command packets usually contain a sequence number that is incremented after each successful packet exchange. The Game Engine and the Player Station intelligence use sequence numbers that are independent of each other. The sequence number keeps the communications in synchronization. This synchronization method is described later.

The command packet is used to send various commands such as Inputs, Lamps, Doors, Errors, Chirp, Game Results, player input, coin acceptance, player identification, credit acceptance, wagers, etc . . . The command packet format may be, by ay of a non-limiting example:

<STX><Sequence number><Data Length><Data><CRC-16><ETX>

The data format with in the command packet may be:

<Address><Command><Field 1>|<Field 2>|<Field n>|

The response packet format may be:

<STX><Sequence number><Disposition><Previous ACK><ETX>

The sync request packet format may be:

<SYN>

The sync response packet format may be:

<STX><Mains Current Transmission Sequence><Mains Current Receive Sequence><ETX>

A major strength of the protocol is its resilience of the Game Protocol and its ability to free up resources within the game engine. Those resources can in turn be used to provide more intricate games, and multi-media affects.

Synchronization Method:

The satellite and host must become synchronized in order to provide for reliable communications using packet numbers. To facilitate this, a novel protocol synchronization method that is used. Upon applying power to the satellite, or after a communications failure, the satellite automatically enters into synchronization mode. In the synchronization mode the satellite sends out the ASCII SYN (0×16) character about every second. It is expecting a special response packet containing transmit and receive packet sequence numbers to be used from that point on. After receiving the special response packet, the sequence numbers are used as-is, and not incremented until the a successful packet exchange. After communications is synchronized, the sequence numbers are incremented after each packet is successfully sent or received.

As was noted before, the main game processor may contain information, data, programming and other necessary fimctions to enable the play of multiple games off the same machine. For example, the main game engine may have rules and commands that will enable play of high and low games of the present invention and other card games. The system may be controlled so that different games may be played at different times on command of the casino or players.

EXAMPLE I

A proposed High-Low Poker game is a five card poker variant game that may be played in electronic (single player video format of multi-player video kiosk format) or preferably a live casino table gaming format.

One or more players plays against a pay table. The underlying play of the game is similar to Shuffle Master, Incorporated's proprietary Let It Ride® stud poker game, but with a different betting structure, different game strategy, different pay tables, and other significant differences that are described herein.

In one embodiment, a player places four initial wagers, referred to herein as Bet 1, Bet 2, Bet 3 and Bet $. Bets 1, 2 and 3 are preferably equal amounts and Bet $ is double that amount (that is, double one of the Bets 1, 2 or 3 amounts). In a five-card poker game, each player is dealt a three-card partial hand, and the dealer is dealt two community cards. In the final ranking of player hands, the two community cards are used to make a five card hand with each of the player's three-card partial hands.

After the player receives the three-card partial hand, each player has the opportunity to withdraw Bet 1. Each player then has the opportunity to withdraw Bet 2 after the first community card is displayed. The house may or may not collect Bet 3 from any player that withdraws Bet 2, but in a mathematically preferred embodiment for the house, Bet 3 is collected by the house when Bet 2 is withdrawn. The player therefore has the opportunity to withdraw ⅖ parts of the initial wager. Bet $ remains in play after withdrawal of Bet 2.

The pay table also includes an even money payout for a Low hand a rank of 9-High and lower on each wager left in play at the end of the betting sequence. The change in the betting structure (with the Bet $ wager) and the addition of the Low hand payout significantly affects both the payout, hold and strategy of the underlying Let It Ride® stud poker game (or a wild card variant thereof). The addition of the Low hand payout increases the hit frequency of a winning hand from 23% (in standard Let It Ride® stud poker) to 40% in the High-Low Poker variant described herein. Also, lowering the minimum high hand payout to a pair of 7's or better further increases the hit frequency of the game. Play strategy is affected as it becomes desirable to remain in the game (and keep additional wagers in play) with initial cards (e.g., 2, 3 and 8) that would ordinarily be nearly worthless in the play of the standard Let It Ride® stud poker game. At the same time that players are more likely to remain in the game with what would ordinarily have been a weak hand (as described above), this tends to keep more optionally wagered money (the withdrawable parts of the wagers) on the table, balancing out the higher frequency of player wins, with a greater amount of money being placed at risk at less than 50% likelihood of winning that wager with weak cards, with the additional payback being at 1:1 odds for the Low hand win against the pay table. These changes in the game significantly impact play and strategy and add whole new dimensions to the play of the game.

The play of the games of this technology may be alternatively described as follows. A first alternative is as a method of playing a wagering poker game comprises:

a player placing at least three wagers;

each player placing an at least three-part wagers being dealt a partial hand that that player can inspect;

a dealer receiving at least two community cards, community cards being positioned face down;

each player electing to withdraw or keep in play a first part of the at least three-part wager before a first of the at least two community cards is exposed; and exposing at least one community card at a time until all community cards are exposed, wherein any of the at least three-part wagers remaining in play upon exposure of all community cards will be paid against a pay table that includes payment for ranks of both a) hands that are equal to or exceed a minimum rank and b) hands that must be equal to or less than a maximum rank.

A second alternative is as a method of playing a wagering poker game comprising:

a player placing at least four wagers, a fourth wager of which must be twice the value of at least one of three of the at least four wagers;

each player placing an at least four-part wagers being dealt a partial hand that that player can inspect;

a dealer receiving at least two community cards, community cards being positioned face down;

each player electing to withdraw or keep in play a first part of the at least four-part wager before a first of the at least two community cards is exposed; and exposing at least one community card at a time until all community cards are exposed, wherein any of the at least three-part wagers remaining in play upon exposure of all community cards will be paid against a pay table that includes payment for ranks of both a) hands that are equal to or exceed a minimum rank and b) hands that must be equal to or less than a maximum rank.

A third alternative is as a method of playing a wagering poker game comprising:

a player placing at least four wagers, three of the four wagers are equal in value, and a fourth wager must be twice the value of each of the three of the four wagers;

each player placing an at least four-part wagers being dealt a partial hand that that player can inspect;

a dealer receiving at least two community cards, community cards being positioned face down;

each player electing to withdraw or keep in play one of the three equal wagers before a first of the at least two community cards is exposed; and exposing a first community card;

after exposure of the first community card, each player electing to withdraw or keep in play a second of the three equal wagers before a second of the at least two community cards is exposed;

then exposing a second community card;

wherein any of the at least three-part wagers remaining in play upon exposure of all community cards will be paid against a pay table that includes payment for ranks of both a) hands that are equal to or exceed a minimum rank and b) hands that must be equal to or less than a maximum rank.

Figure 9:
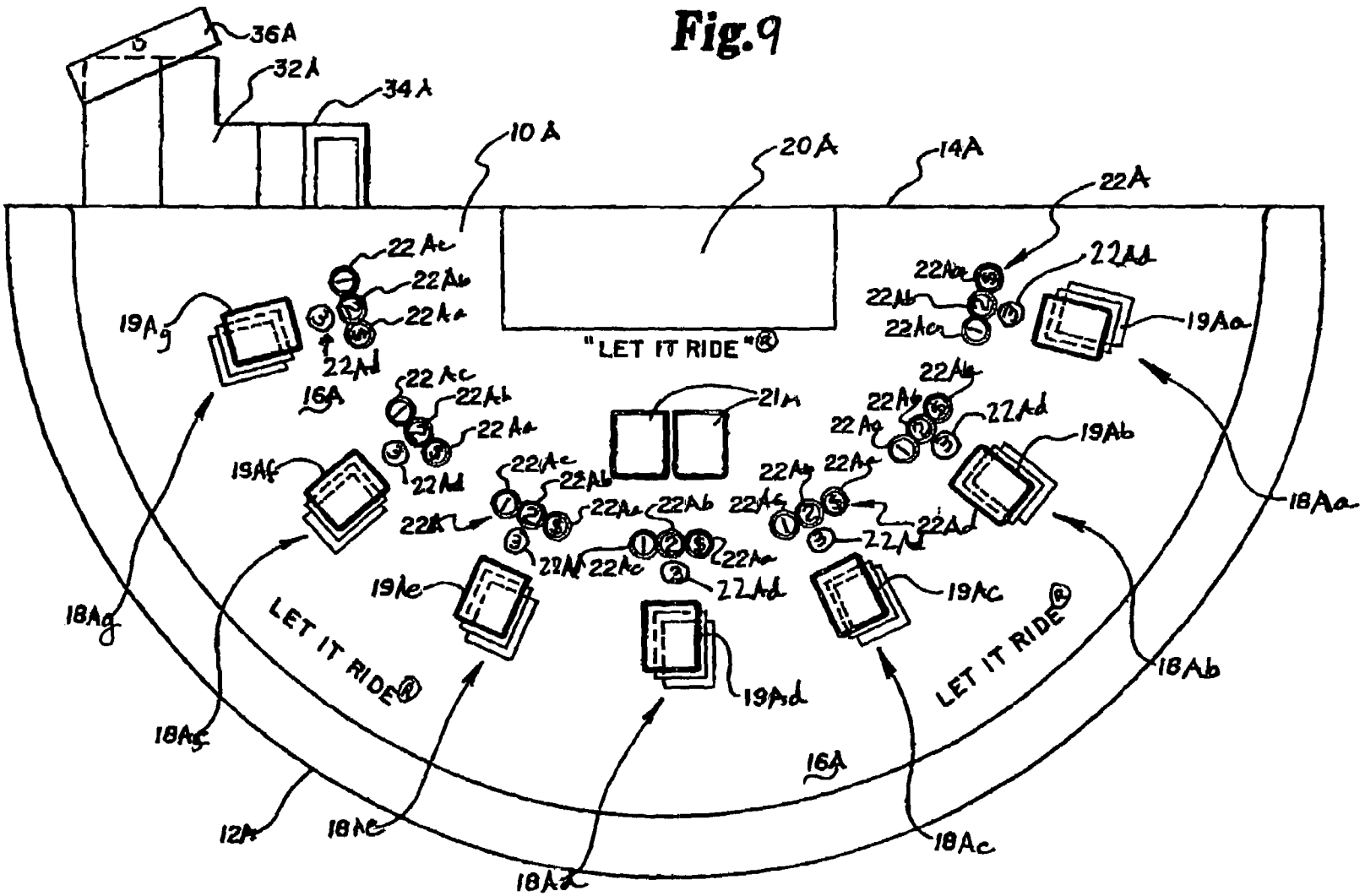
FIG. 9 depicts the table layout and apparatus used in playing the wagering game of the present invention.

Referring to FIG. 9, the apparatus for the wagering game of the present invention includes a typical casino gambling or gaming table 10A. The table 10A has a curved side 12A for accommodating up to seven players and a straight side 14A for accommodating the dealer. The table 10A has a flat surface 16A covered with felt or other appropriate material. Although seven playing positions or locations 18Aa-Ag for individual players are provided, it is not essential to the game that exactly seven persons play and as many as sixteen players may participate. For casino play, a maximum of seven players provides for a game that is easily manageable by the dealer and house, and one in which the individual players feel more involved. A house dealer position 20A, including an area suitable for displaying the dealer's cards 21A, is provided.

Each of the playing positions 18Aa-Ag includes a wagering zone 22A, comprising three separate and four distinct wagering or betting areas 22Aa, Ab, Ac, Ad. Each position 18Aa-g also includes a card area 19Aa-g for receiving and displaying cards dealt to the player occupying the position. The wagering areas 22Aa, b, c, d are designed to receive appropriate wagering indicators or settling means such as chips (not shown). Wagering area 22Ac is specifically designated as the Bet $ position, as later described in detail, but any of the at least three or at least four wagers may be designated for any of these shown positions.

At one side of the dealer station 20A, the apparatus for practicing the method of the present invention may include a microprocessor or computer controlled shuffling machine 32A supported by a table extension 34A. The shuffling machine 32A may be of the type disclosed in U.S. Pat. No. 4,807,884, the disclosure of which patent is incorporated herein by reference. The shuffling machine 32A may include a dealing module for automatically and sequentially dealing cards and also may include a display means for displaying wager amounts, the identity of winning players, or other game related information.

Figure 10:
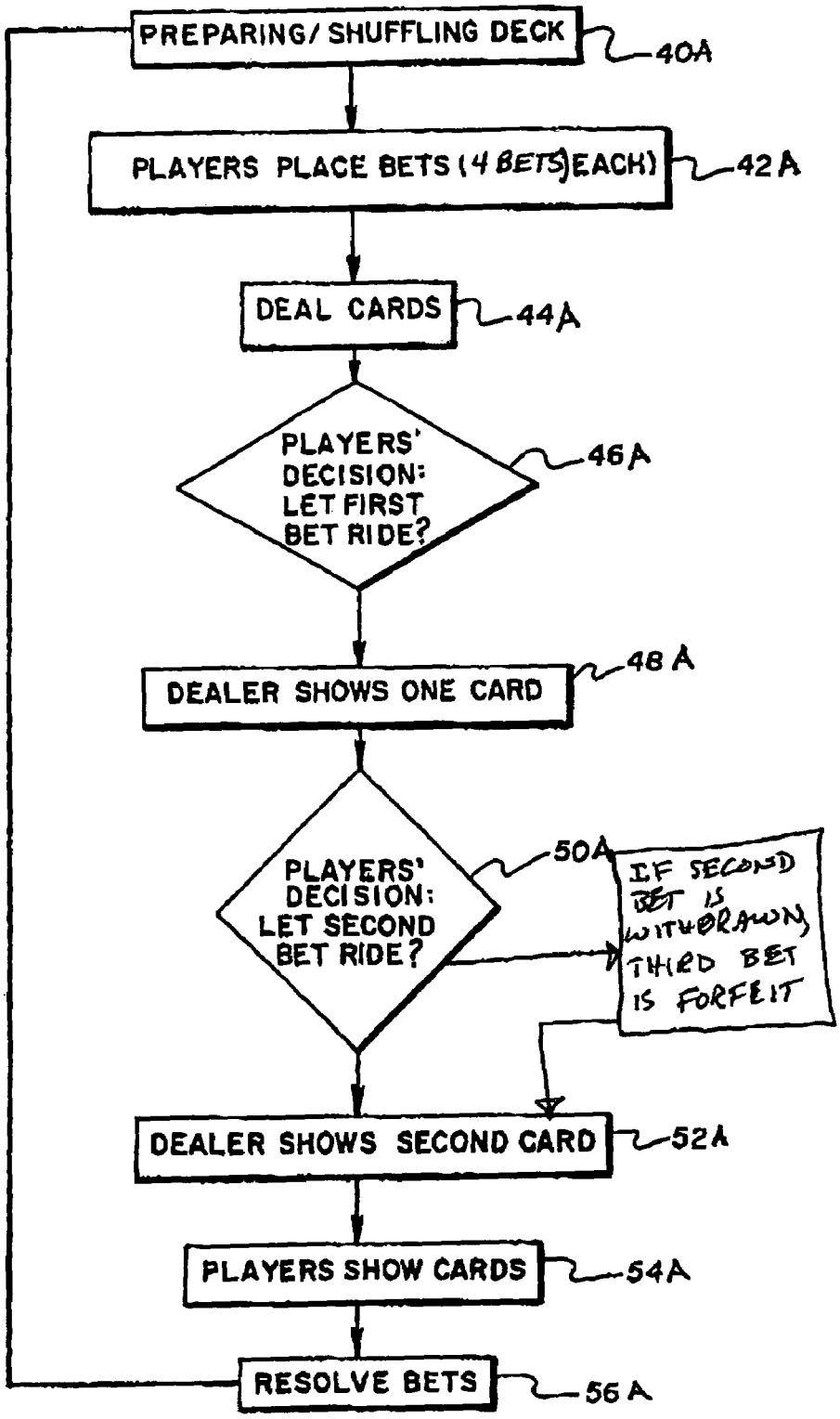
FIG. 10 is a block diagram representing the flow of play in the game.

Referring to the flow diagram of FIG. 10, the initial step in playing the game of the present invention is preparing or shuffling a deck of cards, represented at block 40A, by activating the shuffling machine 32A or by hand-shuffling a deck to provide a shuffled deck. Next, the players place the initial wager, block 42A, by putting three equal first wagers of equal amounts in each of the three betting areas 22Aa, b, d, and an amount that is double each of the three equal first amount into betting area 22Ac. Two of the parts of this initial wager, the parts placed in wagering area 22Aa and 22Ab are retrievable at the option of the player. The third portion placed in area 22Ad and the separate Bet $ wager in 22Ac are nonwithdrawable bets. After the placing of the wager by each player, the cards are dealt, block 44A, three cards being dealt down to each player and two cards are dealt down in front of the dealer.

The players inspect or "sweat" their cards in preparation for reaching decision block 46A. At decision block 46A, the players are queried by the dealer about whether the first part of the initial wager, the part placed in wagering area 22Aa, should be left or whether the player wishes to withdraw that portion of the bet. Each player makes the decision at decision block 46A on the basis of the three cards forming the player's incomplete hand at this point. Once each player has been queried and has decided whether or not to let the first portion of the bet ride, and those bets the player chooses to retrieve or remove are physically removed from area 22Aa and returned to the player, the dealer shows one of the down common cards, block 48A. Now, each player has four cards to consider, the three cards dealt to that player originally and the single common card showing on the table. Each player must then decide whether to let the second part of the initial wager ride or whether to withdraw it from the game. After each player is queried and decides what to do with regard to the second part of the bet, and those bets to be withdrawn are physically removed from area 22Ab and returned to the player, the dealer reveals the second common down card, as represented at block 52A.

Each player now has a five card hand comprised of the three cards each player was originally dealt plus the two revealed common cards. The third bet, the bet placed at wagering area 22Ad, and the BET $ wager in 22Ac are nonretrievable portions of the initial bet and the flow of the game proceeds to block 54A wherein the players show or reveal their three cards to the dealer. The dealer resolves each player's bet (which includes all four parts, three parts, the second and third part with the BET $ wager or only the third part and the BET $ wager, depending on the player's choices during play of the hand) based on the five card hand at block 56A and determines what payout, if any, the player is entitled to receive according to the payout schedule at the particular gaming table or casino. Bets on non-winning hands are collected by the dealer or house. The hand is then over and the flow of the game returns to block 40A, preparing and shuffling the deck for a new hand.

The award or payoff is given for each of the optional bets that were allowed to ride to the end of the hand and for the nonwithdrawable part of the bet. A typical pay table would be as follows:

| Hand | Odds |
|---|---|
| Pair, Tens or Better | 1-1 (even money) |
| Two Pairs | 2-1 |
| Three of a Kind | 3-1 |
| Straight | 4-1 |
| Flush | 6-1 |
| Full House | 9-1 |
| Four of a Kind | 25-1 |

-continued

| Hand | Odds |
|---|---|
| Straight Flush | 50-1 |
| Royal Flush | 250-1 |
| 9-HIGH or lower | 1-1 |

EXAMPLE II

In this example of the invention, the player is playing a primary game against a dealer and a side bet game that has high and low winning hands. The bonus bet pays predetermined odds for certain winning hands. The players and the dealer received five cards each to make a poker hand.

Players make an Ante bet (against the dealer's hand) and receive five cards, for example with all face up or portions up and down, such as three face-up and two face-down of four face-up and one face down. They may also make an optional bonus bet. The dealer deals himself five cards face-down. After looking at the up cards, the players either make a Bet to back up the Ante, or fold. The dealer reveals his hand. The player wins if the five-card poker ranking of the player hand exceeds that of the dealer's hand. In the event of a tie, the bets push.

The players also have the option to make a side wager on a high-low game that is played simultaneously. Regardless of whether the player's hand beats the dealer's hand, if the player places the side bet, he qualifies for payouts for the following hands:

| Hand | Odds |
|---|---|
| Royal Flush | 500:1 |
| Straight Flush | 100:1 |
| Full House | 10:1 |
| Flush | 6:1 |
| Straight | 4:1 |
| Three of a Kind | 3:1 |
| Two Pair | 2:1 |
| Pair of Jacks or better | 1:1 |
| 10 high | 1:1 |
| 9 high | 2:1 |
| 8 high | 3:1 |
| 7 high | 4:1 |
| 6 high | 10:1 |
| 5 high | 50:1 |

Double payouts are possible according to this example of the invention. For example, if a player has a five-high straight, his bonus wins 50:1 on the low hand and 4:1 on the high hand. The high hand rankings are identical to five-card poker, and the low-hand rankings are a modified form of the same ranking structure, except that straights, flushes and straight flushes are ignored.

The method of the present invention is not limited to five card poker games, but may be applied or used in other appropriate games such as seven card poker. The method of the present invention does not require a shuffling machine 32A, dealing module 33A or a display means 36A. However, these facilitate and expedite the play of the game as well as add interest to the game. While the initial wager of the present invention is preferably comprised of three equal bets, the bets do not necessarily have to be equal. While equal bets are essential for casino play, unequal bets may be used in home play, if desired. The wagering game of the present invention might be played live in casinos with a dealer, or in casinos or homes in interactive electronic or video form with automatic coin or betting means receptacles and payout capability, wherein appropriate symbols for cards, wagers or score keeping would be displayed electronically. A "board-type game" suitable for home, club or casino use may also be provided for practicing the method of the present invention.

What is claimed:

1. A method of playing a wagering game, comprising the steps of:

a player placing a first wager to participate in the wagering game;

providing a physical deck of playing cards;

dealing at least a partial hand of cards from the physical deck of playing cards to each player participating in the wagering game;

providing a set of winning outcomes and corresponding payout odds in a paytable, wherein the set of winning outcomes includes at least one predetermined minimum high ranking hand and at least one predetermined maximum low ranking hand;

dealing additional cards that are common cards, if necessary to complete each player hand; and paying a player a payout on the first wager from the paytable for obtaining a winning outcome without requiring the player to make an election as between having at least one predetermined minimum high ranking hand and at least one predetermined maximum low ranking hand.

2. The method of claim 1, wherein all the cards in the complete player's hand are dealt in the initial dealing step.

3. The method of claim 2, wherein the at least a partial hand is fewer than all of the cards forming the hand, and further comprising the step of the player electing to make a second wager prior to receiving the additional cards to complete a hand.

4. The method of claim 2 wherein a pay table is associated with rules of the wagering game that requires payment to a player according to the following conditions:

a pair equal to or greater than a specific rank; and a hand without a pair with a highest card rank in the hand equal to or less than a specific rank selected from the group consisting of Jack, 10, 9, 8, 7, 6 or 5.

5. method of claim 3 wherein the second wager does not require the player to make an election as between having at least one predetermined minimum high ranking hand and at least one predetermined maximum low ranking hand.

6. method of claim 3, wherein when the player elects not to make the second wager, the player folds and loses the ante wager.

7. The method of claim 6, wherein a number of cards in each completed hand is 3, and the predetermined set of game rules for the high-ranking comprises three-card poker rankings, where a straight is a higher rank than a flush.

8. The method of claim 6, wherein the maximum low ranking hand is a 9 high.

9. The method of claim 6, wherein the predetermined set of game rules comprises assigning a numerical value to each card and summing the numerical values in each hand to arrive at a hand count.

10. The method of claim 8, wherein Aces count as 1 or 11 in a low hand according to rules of the wagering game, 1 or 11 in a high hand according to rules of the wagering game, face cards count as 10, and numbered cards count as the respective number printed on the card.

11. The method of claim 1 wherein a pay table is associated with rules of the wagering game that requires payment to a player according to the following conditions:

a pair equal to or greater than a specific rank; and a hand without a pair with a highest card rank in the hand equal to or less than a specific rank.

12. The method of claim 1 wherein a pay table is associated with rules of the wagering game that requires payment to a player according to the following conditions:

a pair equal to or greater than a rank selected from the group consisting of 2, 3, 4, 5, 6, 7, 8, 9 or 10; and a hand without a pair with a highest card rank in the hand equal to or less than a specific rank.

13. The method of claim 1 wherein a pay table is associated with rules of the wagering game that requires payment to a player according to the following conditions:

a pair equal to or greater than a specific rank; and a hand without a pair with a highest card rank in the hand equal to or less than a specific rank selected from the group consisting of Jack, 10, 9, 8, 7, 6 or 5.

14. The method of claim 1 wherein play of the wagering game includes underlying play of pai gow poker with a specific wager on a) a front hand, b) a back hand or c) both front hand and back hand to play the wagering game.

15. The method of claim 1 wherein different rules of ranking are used in determining a minimum high-ranking hand and a maximum low ranking hand.

16. The method of claim 1 wherein the wagering game comprises a stud poker game.

17. The method of claim 1 wherein the wagering game comprises a draw poker game with standard hand rankings used to determine low hands.

18. The method of claim 1 wherein the wagering game requires the use of community cards for players.

19. A method of playing a wagering game, comprising the steps of:

a player placing a first wager to participate in the wagering game;

providing a physical deck of playing cards;

dealing at least a partial hand of cards from the physical deck of playing cards to each player participating in the wagering game;

providing a set of winning outcomes and corresponding payout odds in a paytable, wherein the set of winning outcomes includes at least one predetermined minimum high ranking hand and at least one predetermined maximum low ranking hand;

dealing additional cards that are common cards, if necessary to complete each player hand; and paying a player a payout on the first wager from the paytable for obtaining a winning outcome without requiring the player to make an election as between having at least one predetermined minimum high ranking hand and at least one predetermined maximum low ranking hand wherein a pay table is associated with rules of the wagering game that requires payment to a player according to the following conditions;

there are at least two different odds available for a high hand, one different odds being for a pair equal to or greater than a specific rank, and a second different odds being for three-of-a-kind; and a hand without a pair with a highest card rank in the hand equal to or less than a specific rank.

20. A method of playing a wagering game, comprising the steps of:

a player placing a first wager to participate in the wagering game;

providing a physical deck of playing cards;

dealing at least a partial hand of cards from the physical playing deck of cards to each player participating in the wagering game;

providing a set of winning outcomes and corresponding payout odds in a paytable, wherein the set of winning outcomes includes at least one predetermined minimum high ranking hand and at least one predetermined maximum low ranking hand;

dealing additional cards that are common cards, if necessary to complete each player hand; and paying a player a payout on the first wager from the paytable for obtaining a winning outcome without requiring the player to make an election as between having at least one predetermined minimum high ranking hand and at least one predetermined maximum low ranking hand wherein a pay table is associated with rules of the wagering game that requires payment to a player according to the following conditions:

a pair equal to or greater than a specific rank; and there are at least two different odds available for a low hand, one different odds being for a hand without a pair with a highest card rank in the hand equal to or less than a first specific rank, and a second odds being for a hand without a pair with a highest card in the hand equal to or less than a second specific rank, the second specific rank being lower than the first specific rank.

21. A method of playing a wagering game, comprising the steps of:

a player placing a first wager to participate in the wagering game;

providing a physical deck of playing cards;

dealing at least a partial hand of playing cards from the physical deck of cards to each player participating in the wagering game;

providing a set of winning outcomes and corresponding payout odds in a paytable, wherein the set of winning outcomes includes at least one predetermined minimum high ranking hand and at least one predetermined maximum low ranking hand;

dealing additional cards that are common cards, if necessary to complete each player hand; and paying a player a payout on the first wager from the paytable for obtaining a winning outcome without requiring the player to make an election as between having at least one predetermined minimum high ranking hand and at least one predetermined maximum low ranking hand wherein a pay table is associated with rules of the wagering game that requires payment to a player according to the following conditions:

there are at least two different odds available for a high hand, one different odds being for a pair equal to or greater than a specific rank, and a second different odds being for three-of-a-kind; and there are at least two different odds available for a low hand, one different odds being for a hand without a pair with a highest card rank in the hand equal to or less than a first specific rank, and a second odds being for a hand without a pair with a highest card in the hand equal to or less than a second specific rank, the second specific rank being lower than the first specific rank.

22. A method of playing a wagering game, comprising the steps of:

a player placing a first wager to participate in the wagering game without competing against a dealer hand;

providing a physical deck of playing cards;

dealing at least a partial hand of cards from the physical deck of playing cards to each player participating in the wagering game;

providing a set of winning outcomes and corresponding payout odds in a paytable, wherein the set of winning outcomes includes at least one predetermined minimum high ranking hand and at least one predetermined maximum low ranking hand;

dealing additional cards without replacing or exchanging cards, if necessary to complete each player hand; and paying a player a payout on the first wager for obtaining a winning outcome without requiring the player to make an election as between having at least one predetermined minimum high ranking hand against a paytable and at least one predetermined maximum low ranking hand against a paytable.

23. The method of claim 22 wherein all the cards in the complete player's hand are dealt in the initial dealing step without exchanging or replacing any cards.

24. The method of claim 23 wherein a pay table is associated with rules of the wagering game that requires payment to a player according to the following conditions:

a pair equal to or greater than a specific rank; and a hand without a pair with a highest card rank in the hand equal to or less than a specific rank.

* * * * *